US006397759B1

(12) United States Patent
Hubert et al.

(10) Patent No.: US 6,397,759 B1
(45) Date of Patent: Jun. 4, 2002

(54) NON-ELECTRIC LOCOMOTIVE AND ENCLOSURE FOR A TURBINE ENGINE FOR A NON-ELECTRIC LOCOMOTIVE

(75) Inventors: Daniel Hubert, St-Jean-sur-Richelieu; Bernard Raynauld, Charlemagne; Jean Desrosiers, Laval, all of (CA)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 09/628,802

(22) Filed: Jul. 28, 2000

Related U.S. Application Data

(60) Provisional application No. 60/203,584, filed on May 11, 2000.

(51) Int. Cl.[7] ..... B61C 5/02; B61C 5/04

(52) U.S. Cl. ..... 105/26.05; 105/36; 105/38; 105/61.5; 105/140

(58) Field of Search ..... 105/26.05, 36, 105/38, 61.5, 140

(56) References Cited

U.S. PATENT DOCUMENTS

| | | | | | |
|---|---|---|---|---|---|
| 3,703,146 | A | * | 11/1972 | Kovats | 105/61.5 |
| 3,862,604 | A | * | 1/1975 | Pelabon | 105/61.5 |
| 3,868,908 | A | * | 3/1975 | Pelabon | 105/61.5 |
| 3,886,870 | A | * | 6/1975 | Pelabon | 105/61.5 |
| 5,129,328 | A | * | 7/1992 | Donnelly | 105/61.5 |

OTHER PUBLICATIONS

Ice 3 on Right Tracks for High–Speed Rail Harmonisation–Passenger Rail Management, vol. 4, Issue 4, Nov. 1996, by Jurgen Prem., p. 19.

All Aboard for High–Speed Rail–Mechanical Engineering, Sep. 1996, by David Herman, pp. 94–97.

American Flyer–Popular Mechanics, Nov. 1996, by Jim Wilson, pp. 56–59.

Le Difficile Avenement Du<<Cisalpino>>Rail Passion, N 10 Jul. 1996, by Philippe Herisse, pp. 46–48.

Quatre Pistes Pour L'Apres Grande Vitesse, La vie du Rail & des transports, N 2541, Apr. 10, 1996, by Dumont, Francois et al., pp. 14–18.

A Bord Du Nouveau Train Pendulaire Italien, La vie du Rail & des transports, N 2539, Mar. 27, 1996, p. 11.

Refined Gas Turbines Offer Lower Costs—Railway Gazette International, Jun. 1994, p. 401.

Le Pendulaire Dans La Course A L'Ecosse—La vie du Rail & des transports, N. 2610, Sep. 3, 1997, p. 10.

Electric or Diesel: Tilting May Tip the Balance—Railway Gazette International, Aug. 1997, by Felix Schmid, pp. 521–524.

Faster Through the Curves on JR–Central–Railway Gazette International, Aug. 1997, by Kazuhiro Yoshikawa, pp. 531–532.

(List continued on next page.)

*Primary Examiner*—Stephen T. Gordon
*Assistant Examiner*—Gregory Blankenship
(74) *Attorney, Agent, or Firm*—Pillsbury Winthrop LLP

(57) ABSTRACT

A locomotive is described including a frame having a wall with a roof and floor defining an enclosed space thereon. A turbine engine is disposed within the enclosed space. An air inlet is provided to permit ingress of air into the enclosed space for ingestion by the turbine and for circulation around the turbine to cool the turbine. A first silencer is disposed between the air inlet and the turbine to minimize noise generated by the turbine. An exhaust duct, for connection to the exhaust outlet of the turbine, is also provided to permit egress of exhaust gases generated by the turbine from the enclosed space. In addition, a second silencer, connected to the exhaust duct, is provided to minimize noise generated by the turbine. Finally, at least one of the wall, roof, and floor of the enclosed space incorporate noise dampening materials to minimize noise generated by the turbine. An enclosure assembly for a turbine is also disclosed.

68 Claims, 16 Drawing Sheets

OTHER PUBLICATIONS

Bombardier's Tilt Prototypes to Test Virgin Bogies–Rail Transport International, Jul./Aug. 1998, by David Haydock, pp. 34–35.

Axis: Quand La RTG Devient Pendulaire, La vie du Rail & des transports, Jun. 3, 1998, by Alain Wairt, p. 6.

Talent, First of a New Generation of DMUS–Rail Transport International, Mar./Apr. 1998, pp. 4–5.

Prototype Talgo XXI on Test–International Railway Journal, Jan. 1999, p. 25.

Axis: Le Demonstrateur Pendulaire de Bombardier, Revue Generale des Chemins de Fer, Jan., 1999, pp. 57–58.

* cited by examiner

NON-ELECTRIC LOCOMOTIVE AND ENCLOSURE FOR A TURBINE ENGINE FOR A NON-ELECTRIC LOCOMOTIVE

This application relies for priority on U.S. Provisional Patent Application Serial No. 60/203,584, entitled "NON-ELECTRIC LOCOMOTIVE AND ENCLOSURE FOR A TURBINE ENGINE FOR A NON-ELECTRIC LOCOMOTIVE," which was filed on May 11, 2000. The entirety of that application is incorporated herein by reference.

FIELD OF THE INVENTION

The present invention generally relates to the construction of non-electric, turbine-powered train locomotives. More particularly, the present invention relates to the design and construction of an enclosure surrounding the turbine engine that powers a non-electric locomotive.

BACKGROUND OF THE INVENTION

Considering the frequency with which many people travel in today's modern world, and considering the time constraints that those people encounter in their daily lives, air travel has become a primary mode of transportation. Rail travel (or travel by train) has become a less attractive alternative because trains cannot compete with the speed of travel, and therefore the convenience of short travel time, that airplanes offer.

Accordingly, a need has developed for rail travel providers to consider alternative ways in which they can compete with air travel providers. One solution that presents itself is the development of trains that operate at higher than conventional speeds, for example, speeds from 125 to 150 miles per hour (m.p.h.) (and possibly even greater speeds up to or more than 165 m.p.h.). While this solution is simple, the application of this solution to the problem is not.

The dynamic forces exerted by the wheels of a locomotive on existing tracks are one of the most significant issues to be addressed before trains may be permitted to operate at high speeds, especially on North American railways. Conventional diesel-electric passenger locomotives (a common example of which is the "F40" locomotive, to which reference is made throughout) generally weigh around 260,000 lbs. In addition, they have high unsprung masses (about 8,540 lb./axle) due to the standard arrangement of the motors on the axles. (The "unsprung weight" refers to the weight of the components, especially the traction motors, which are mounted directly on the truck axle below the primary suspension. The high unsprung weight of the F40 locomotive results, at least in part, from the traction motors being mounted directly onto the axles.

At high speeds, the weight and unsprung mass of conventional diesel-electric locomotives exert significant dynamic forces on the rails. The dynamic forces, of which the unsprung weight is a significant contributing factor, are induced onto the tracks at locations where the locomotive crosses irregularities in the tracks, such as where the rails are welded or soldered to one another. The greater the dynamic forces exerted on the rails, the more rapidly the rails wear and the more frequently maintenance is required.

There are two solutions to this problem that are immediately apparent. First, the rails can be redesigned to withstand the dynamic forces exerted by conventional diesel-electric locomotives at high speeds. Second, the locomotives can be redesigned to minimize wear on the rails.

While technologically feasible, the first option is not financially attractive. Upgrading existing rails so that they can withstand the dynamic forces that a diesel-electric locomotive would exert at 125–150 m.p.h. requires that the rails be significantly redesigned or replaced entirely. This is prohibitively expensive. Therefore, engineers have focused on the second of the two solutions.

Since the weight and unsprung mass of locomotives are the primary contributing factors to the dynamic forces exerted on the rails, engineers have focused on designing lighter locomotives that have a lower unsprung mass. When considering this option, two choices are possible: (1) an electric locomotive, i.e., a locomotive that draws power from an electrified rail or overhead cable, or (2) a non-electric locomotive, i.e., a locomotive that generates it own power (without an electrified rail or overhead cable). The first option is hereinafter referred to as the "all-electric" option.

It should be noted that electric and non-electric locomotives both may use electrical energy to one degree or another, i.e., to power the electric traction motors for propulsion. The distinction here is that a non-electric locomotive generates its own electrical power while an electric locomotive relies on an external power source, such as an electrified rail or overhead cable, for electrical energy. In other words, the appellation "non-electric locomotive" is not meant to convey that the locomotive operates without electrical energy of any kind.

The all-electric option offers potentially the greatest reduction in the weight of the locomotive because the locomotive does not need to carry its own power generator (s). Instead, the locomotive receives its power from an external source. While this option potentially leads to the lightest locomotive design, it requires a significant investment because existing rails must be electrified (by providing a power rail or electrified overhead cable). It has been estimated that the cost of electrifying a single mile of track could cost between $3 and $5 million dollars. This is cost prohibitive in most geographic areas because there is insufficient passenger ridership to justify the expenditure.

Therefore, from the options listed, the most viable proposition for a high-speed train locomotive for use on as many railways as possible is a non-electric locomotive with a weight and unsprung mass that is lower than the conventional diesel-electric locomotive. One way to accomplish this objective is to provide a locomotive with a low-weight power generator, such as a turbine engine.

Two primary characteristics of turbine engines, however, offer significant challenges to their use in locomotives. First, turbine engines generate a considerable amount of heat. This requires powerful cooling systems to remove the heat from the engine while it is running. Second, turbine engines consume a large volume of air during operation. This requires the incorporation of systems in the locomotive design that accommodate this need.

Despite these engineering challenges, turbine engines are significantly lighter (in weight) than the internal combustion engines that are conventionally used. The reduced weight of turbine engines as compared to conventional (i.e., diesel) engines offers a compelling reason for engineers to overcome the challenges associated with reliance on turbine-generated power in locomotive applications.

The use of turbine-power (of one sort or another) has been proposed for locomotives in the past. For example, U.S. Pat. No. 2,533,866 describes an electric locomotive with a coal-fired, gas-turbine power plant to generate power by using the exhaust gases produced when coal is burned. The turbine is connected to electrical generators that are, in turn connected to the driving motors on the locomotive.

U.S. Pat. No. 2,637,277 describes a specific construction for a locomotive with a gas turbine power plant. Specifically, the patent describes how irregularities in the roadbed over which a locomotive travels can generate forces that longitudinally twist the frame of the locomotive. This twisting can be transmitted to the rotary units on the locomotive and cause the shafts of the units that are connected together to become misaligned. The patent is directed to a support structure that renders harmless any longitudinal twisting of the locomotive frame as it passes over an uneven roadbed. The locomotive described includes a gas turbine power plant connected to an electric generator that supplies power to a plurality of traction motors that drive the locomotive.

U.S. Pat. No. 3,862,604 describes a locomotive engine compartment for a turbine-powered locomotive. Specifically, the patent describes grouping the power components of the locomotive in a compact arrangement within a room that is both thermally and acoustically insulated. Being insulated, the room can be located a fairly short distance from passenger and baggage compartments. The room is divided into two parts: (1) a first part called the "stabilization chamber," in which, after passing through the scoop, the air expands before entering the air filter; and (2) a second part, called the "turbine compartment," which accommodates the main and auxiliary turbines and exhaust release.

U.S. Pat. No. 4,087,961 describes a fuel control system for a gas turbine engine operated on gaseous fuel. Specifically, the fuel control system is designed to provide a limit switch that prevents overheating of the turbine engine. When additional power is demanded, the governor that controls the flow of fuel to the turbine may open fully and remain opened for extended periods of time. To prevent overheating of the engine, a system is provided that measures the compressor discharge pressure and prevents the fuel metering valve from opening beyond a certain position even though the governor may call for more fuel.

Finally, U.S. Pat. No. 5,129,328 describes a locomotive incorporating a gas turbine engine that uses natural gas as its fuel. The turbine is connected directly to an alternator without a gearbox. To fuel the locomotive, a number of separate cylindrical containers are provided on the locomotive frame to contain the natural gas fuel at a pressure of about 3,000 pounds per square inch.

While each of these patents address certain issues associated with the use of turbine power for locomotives, the combination of elements, as described below, is entirely new.

SUMMARY OF THE PRESENT INVENTION

The present invention offers a new and unique approach to the use of turbine engines as the power source for train locomotives.

Specifically, it is an object of the present invention to offer a unique construction for the enclosure for the turbine engine that dissipates heat generated by the engine during operation.

It is another object of the present invention to provide a unique construction for the enclosure assembly that accommodates the large air intake required by the turbine engine without the need for ducting.

In addition, it is an object of the present invention to provide a diesel-fueled turbine-powered locomotive that exerts smaller dynamic forces on the rails over which it travels than a conventional diesel-electric locomotive, such as the F40 locomotive.

BRIEF DESCRIPTION OF THE DRAWINGS

Particular embodiments of the present invention will be understood in conjunction with the accompanying drawings, in which.

DESCRIPTION OF THE PREFERRED EMBODIMENTS

Figure 1:
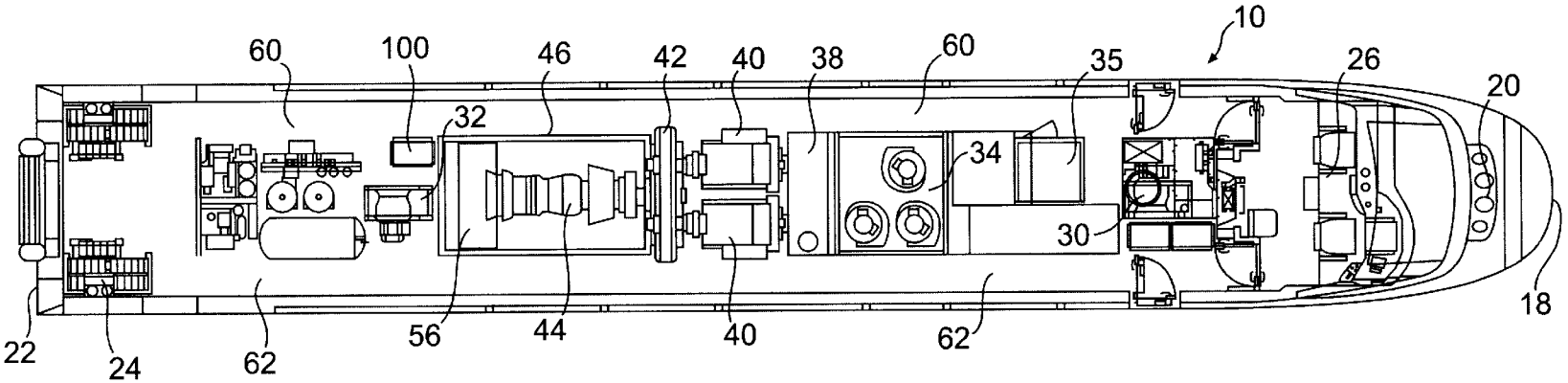
FIG. 1 is a top view schematic illustration of the locomotive of the present invention.
Figure 2:
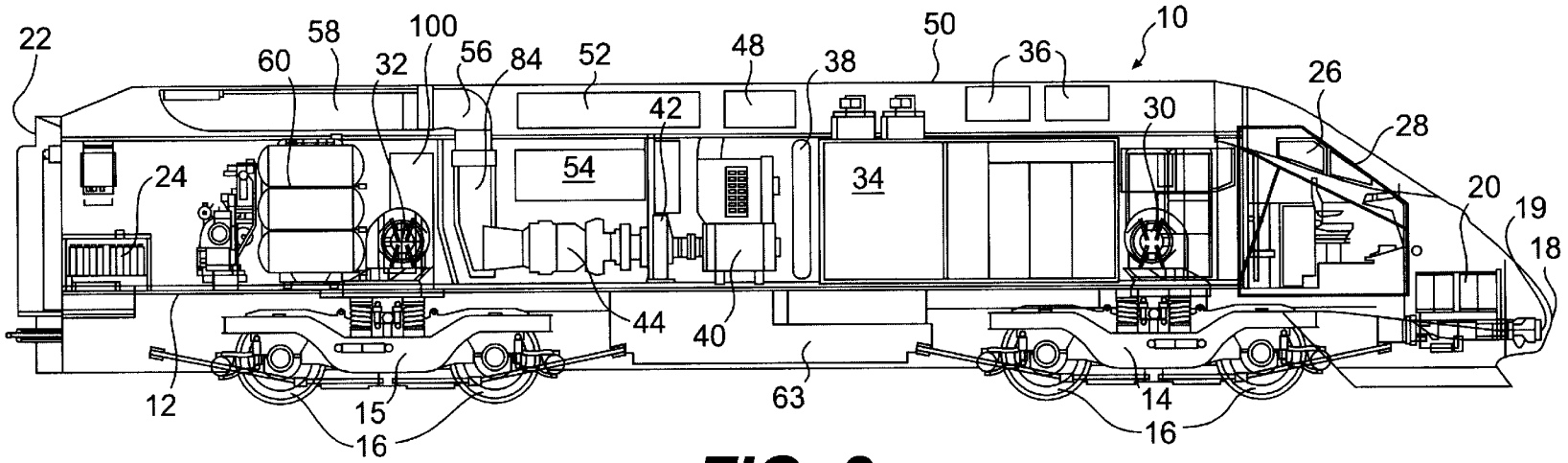
FIG. 2 is a side schematic view of the locomotive illustrated in FIG. 1.

The non-electric locomotive of the present invention is generally designated 10 in FIGS. 1 and 2. Locomotive 10 consists of a frame 12 that is positioned atop two trucks (or Bogies) 14, 15. Trucks 14, 15 each have four wheels 16 that engage the rails or tracks over which the locomotive operates.

At its forward end 18, locomotive 10 incorporates an engineered crushable zone 20 that permits a controlled deformation and collapse of the forward-most portion 18 of locomotive 10, should it collide with a stationary or moving object. Rear 22 of locomotive 10 also incorporates an engineered crushable zone 24 that is designed to absorb some of the energy from an impact (specifically, the energy from the car behind locomotive 10 as it impacts with locomotive 10). Front zone 20 is designed to absorb approximately 5 MJ of energy and rear zone 24 is designed to absorb about 3 MJ of energy. Accordingly, the two zones together are designed to absorb about 8 MJ, which equates to approximately 5.9 million foot-pounds of energy. Engineered crushable zones 20, 24 are non-occupied sections of locomotive 10 that collapse and absorb collision energy and reduce the deceleration forces experienced by the passengers and the crew.

Cab 26 is positioned just behind front crushable zone 20. Cab 26 incorporates a frame 28 (shown in FIG. 2) that is designed with high-strength corner posts, collision posts and anti-penetration posts to form a robust cab structure. The under-frame has a longitudinal compressive strength of 2.1 million pounds. This provides a high degree of protection for the locomotive engineer.

Figure 14:
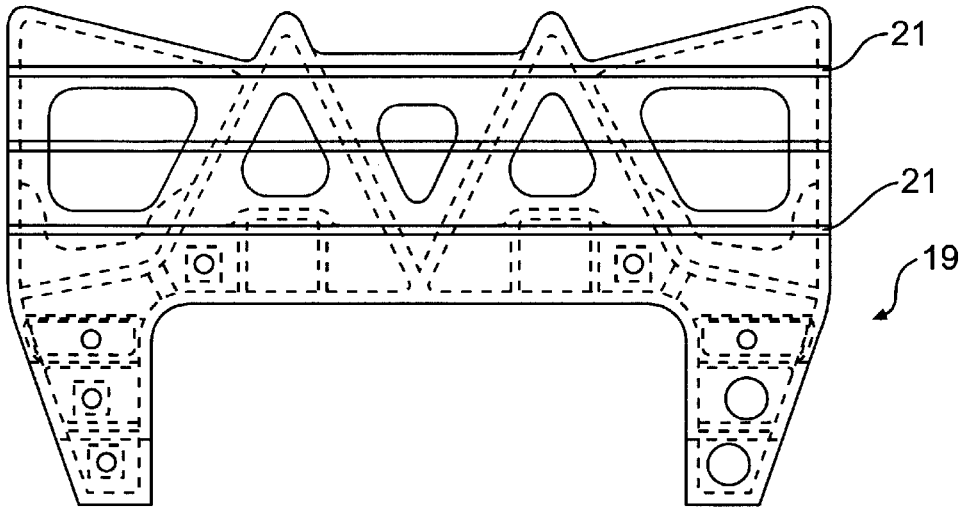
FIG. 14 is a front end view of the anti-climbing device of the present invention.
Figure 15:
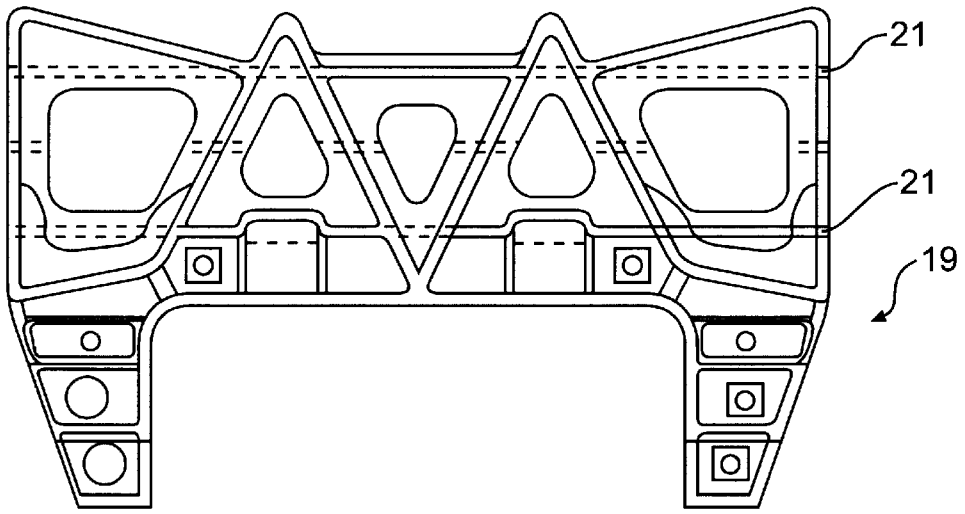
FIG. 15 is a rear end view of the anti-climbing device of the present invention.

In addition, locomotive 10 incorporates an anti-climbing mechanism 19 into its structure to resist vehicle over-ride. Anti-climbing mechanism 19, which is shown in greater detail in FIGS. 14 and 15, is provided in the nose of locomotive 10. Anti-climbing mechanism 19 is made up of a plurality of parallel metal ribs 21 disposed behind forward end 18 of locomotive 10. When locomotive 10 impacts with another locomotive that also incorporates anti-climbing mechanism 19 at its forward end, ribs 21 on both locomotives interlock with one another to prevent either locomotive from riding up over the other during the collision. Anti-climbing mechanism 19 is designed to resist an upward or downward static vertical force of 200,000 lbs.

A traction motor blower 30 is positioned rearwardly of cab 26. Traction motor blower 30 circulates air around the traction motors (two are preferred) at the forward truck 14 to keep the temperature of the motors within operating tolerances. A second traction motor blower 32 circulates air around the traction motors (two are preferred) at rear truck 15.

A motor block 34 is positioned rearwardly from motor traction blower 30. Motor block 34 houses the power electronics and associated cooling equipment for locomotive 10. Motor block 34 converts the DC power from alternators 40 to the AC power required by the traction motors. Rheostatic grids 36 are disposed above motor block 34 as shown in FIG. 1. A lavatory 35 is also located in the vicinity of motor block 34 as illustrated in FIG. 1.

A fuel and oil rack assembly 38 is disposed rearwardly from motor block 34, between motor block 34 and alternators 40. Fuel and oil rack assembly 38 includes the fuel and oil filters, pumps, and heat exchangers for the fuel and oil systems on locomotive 10. Fire suppression cylinder 66, which is discussed in greater detail below, is also located in the same area.

Alternators 40 are positioned behind fire fuel and oil rack 38 on locomotive 10. Alternators 40 are connected to gearbox 42, which is disposed rearwardly from alternators 40. In turn, gearbox 42 is connected to turbine 44, which is disposed rearwardly from gearbox 42. Turbine 44 is enclosed within an enclosure assembly 46, which is described in greater detail below.

While the preferred embodiment of locomotive 10 includes gearbox 42 and two alternators 40, it is contemplated that gearbox 42 can be eliminated entirely from locomotive 10. In such a construction, the turbine can be connected directly to a single alternator for generation of electrical power. This greatly simplifies the construction and maintenance of the locomotive. Furthermore, such a construction reduces the weight of the locomotive, because approximately 10,000 lbs. of equipment can be removed therefrom.

Preferably, turbine 44 is a gas-powered turbine engine with 5,000 horsepower (hp) of installed power. The "installed" qualifier indicates that turbine 44 can develop the complete 5,000 hp when the inlet and exhaust pressure drops at ambient conditions have been taken into account. In the preferred embodiment of locomotive 10, turbine 44 is an XT40, an industrial version of the PW150 engine furnished by United Technologies, which has been certified for use on the Dash 8-400 airplane. The PW150 turbine engine is rated as a 6,500–7,500 hp class engine in its aerospace configuration. It provides 5,000 hp without using its turbine boost capability. It weighs between about 1,200 and 1,500 lbs., depending upon the configuration.

Figure 11:
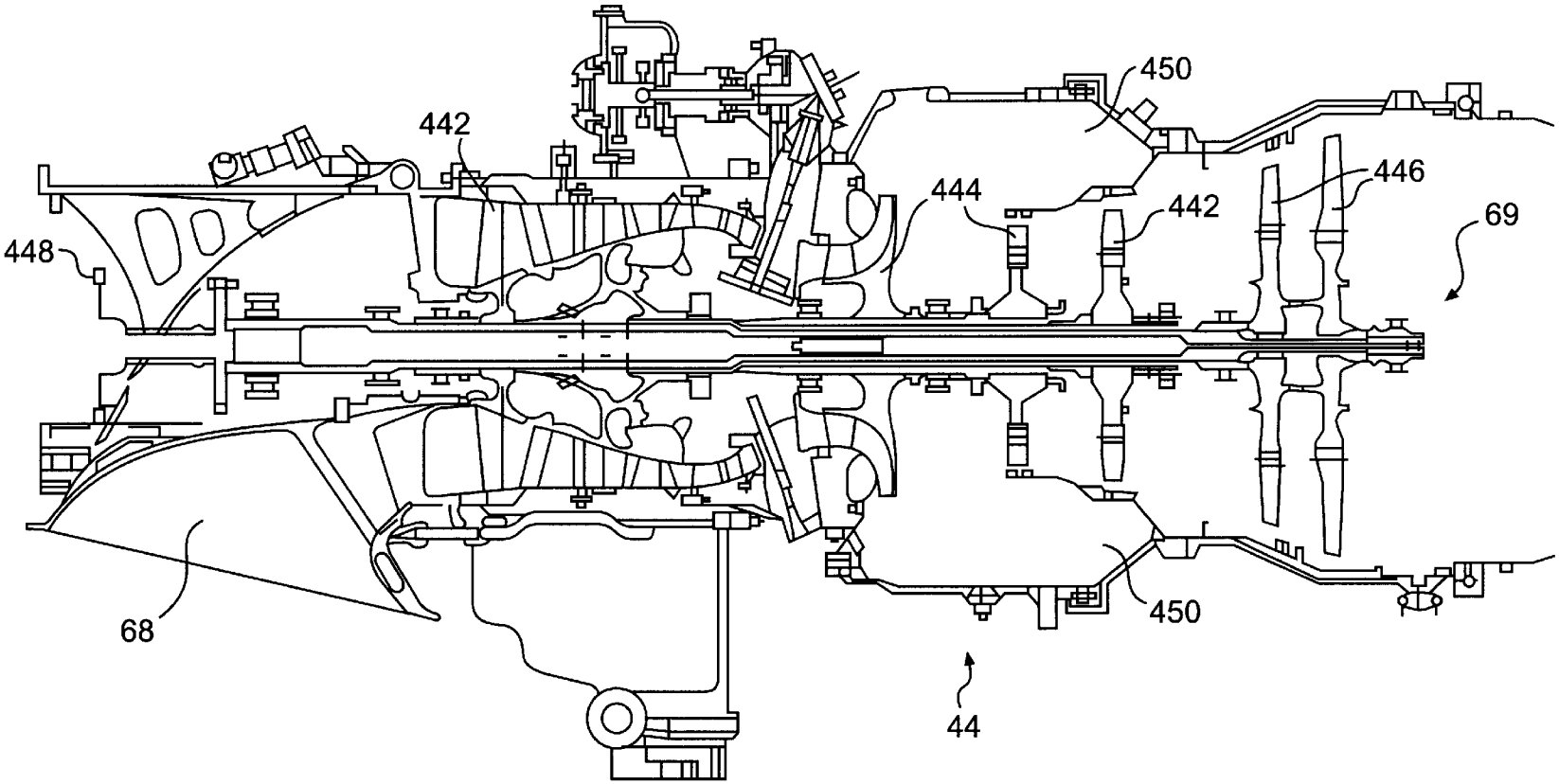
FIG. 11 is a side view schematic illustration of the turbine generator preferred for use on the locomotive of the present invention.

The XT40 turbine engine selected for this application is a triple shaft engine with a three-stage axial low pressure compressor 442, one centrifugal high pressure compressor 444, followed by a two-stage free power turbine 446, as illustrated schematically in FIG. 11. A turbine with these design parameters is easier to start than double and (especially single shaft configurations. Also, the three shafts, which are independent from each other, rotate in opposite directions, which dampens the vibration level of turbine 44. Significantly, the variable output of turbine speed provides the control flexibility required to interface this prime mover into the propulsion system of locomotive 10. The variable output power turbine speed also allows shorter reaction time to meet the power demand of the propulsion system and permits fuel consumption optimization.

The XT40 turbine selected for the present invention is considered a straight flow turbine since the air is drawn at the front of the engine (at inlet 68) and the exhaust is discharged at the rear of the engine (at outlet 69). Turbine 44 also incorporates a reverse flow combustion chamber 450 that results in a shorter and lighter engine. Finally, turbine 44 is a cold end drive engine. The power take off 448 is at the front of the unit, typical of a turbo-prop engine, and is linked to the double stage power turbine at the center power shaft. While the power take off is located at the front of the unit for the preferred turbine engine, it should be appreciated that the power take off could be located equally at the rear of the engine.

As would be understood by those skilled in the art, an XT 40 turbine engine is not required to practice the present invention. Other suitable turbine engines could be substituted therefor without departing from the scope of the present invention. Whatever turbine is selected, however, it is preferred that the turbine have two or more shafts and that it be compact in size. As discussed, a multi-shaft turbine is easier to start and control than a single shaft turbine. Moreover, the multiple shafts rotate in opposite directions to dampen vibrations generated by the turbine.

Not only is a multiple-shaft turbine preferred, but a turbine that is light-weight is also preferred. Specifically, a turbine should be selected that weighs no more than about 5,000 lbs. More preferably, the turbine should weigh less than 4,000 lbs. It is still more preferred that the turbine weigh no more than 3,000 lbs. Even more preferably, the turbine should weigh no more than 2,000 lbs. Still more preferred is a turbine that weighs less than 1,500 lbs. In its most preferred embodiment, the turbine should weigh about 1,200 lbs. or less.

Figure 13:
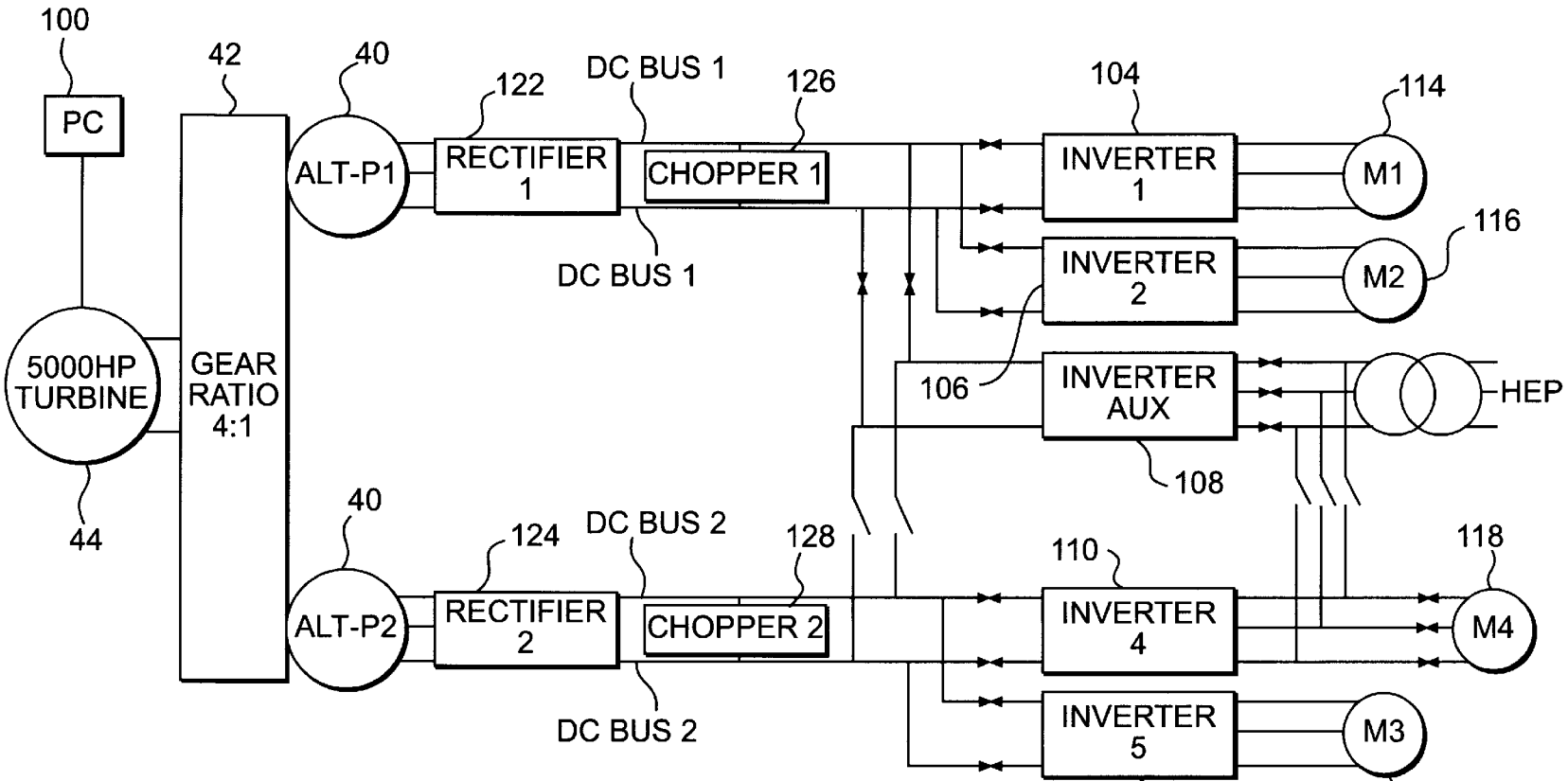
FIG. 13 is a block diagram of the propulsion control circuit of the locomotive of the present invention.

For locomotive 10, the dual channel Full Authority Digital Electronic Controller (FADEC) found on aeronautic versions of the engine has been replaced with a PC-based controller 100, the operating scheme of which is depicted generally in FIG. 13. The PC-based controller 100, the general location of which is illustrated in FIGS. 1 and 2, not only controls and monitors the turbine fuel flow and various sensors, it also controls and monitors all turbine auxiliaries, provides an interface with the propulsion system, and incorporates the power control loop architecture. The engine monitoring software also allows for easier and more flexible operation that will also enable an "on condition" maintenance approach to simplify and reduce the engine maintenance cycle.

Preferably, the propulsion system for locomotive 10 is based upon Isolated Gate Bipolar Transistor (IGBT) technology, which provides a larger power capacity in a smaller space than conventional technologies. The propulsion system consists of high voltage equipment, two alternators 40, two rectifiers 122, 124, five power inverters 104, 106, 108, 110, 112, and four traction motors 114, 116, 118, 120 (FIG. 13). Turbine 44 drives the two traction alternators 40 through a high-speed gearbox 42. Alternators 40, which are directly derived from service-proven synchronous motors that provide traction power on the TGV (Train de Grand Vitesse) Atlantique and TGV Reseau, are supplied with forced cooling air.

The output of each alternator 40 (one per truck 14, 15) is rectified by a three-phase diode bridge. The direct current (DC) output of each rectifier 122, 124 is regulated at 1960 volts (VDC). DC Bus 1 supplies the traction inverters of Bogie 1 (truck 14) and the auxiliary inverter 108, while DC Bus 2 supplies the traction inverters of Bogie 2 (truck 15).

Each traction motor 114, 116, 118, 120 is supplied by a dedicated inverter 104, 106, 110, 112. The asynchronous traction motors 114, 116, 118, 120 are rated at 1106 hp (825 kW) each. One traction motor blower 30, 32 per truck 14, 15 is capable of cooling the two traction motors thereon, respectively. Traction motors 114, 116, 118, 120 are all suspended from frame 12 and, as a result, are sprung masses that do not contribute to the unsprung weight of locomotive 10.

The remaining inverter 108, which is preferably identical to the traction inverters 104, 106, 110, 112, is connected to DC Bus 2. Inverter 108 supplies the train auxiliaries by providing up to 500 kW of Head End Power at 480 VAC 3-phase. In case of failure of auxiliary inverter 108, one traction inverter from DC Bus 2 takes over and supplies the load via the same auxiliary transformer. The redundant feature is provided while maintaining 75% of the locomotive power available for traction. The flexibility of the propulsion system reconfiguration plays an important role in the overall availability of locomotive 10.

It should be noted that remaining inverter 108 could provide a greater amount of power than the 500 kW described above. Since the inverter 108 is the same as inverters 104, 106, 110, and 112, all of which are rated to 825 kW, there is no reason why remaining inverter 108 cannot supply up to 825 kW. However, as mentioned, for the present invention, inverter 108 is limited to 500 kW of power.

To brake, the traction motors 114, 116, 118, 120 operate as asynchronous generators, feeding the power DC bus at its nominal voltage by means of inverters acting as three-phase rectifiers. An assembly of resistor grids 36 integrated on roof 50 of locomotive 10 is connected to the DC power bus to provide total braking power of 2600 kW.

Two choppers 126, 128 are also illustrated in FIG. 13. Choppers 126, 128 provide what is commonly referred to as a "crowbar function," which means that choppers 126, 128 limit the voltage to 2400 VDC. Choppers 126, 128 also control the power to rheostatic grids 36 for braking.

Rheostatic grids 36 are basically a bank of resistive elements that convert electrical energy to heat, which is then vented into the atmosphere. Rheostatic grids 36 are part of the braking system of locomotive 10. During braking, traction motors 114, 116, 118, 120 operate as asynchronous generators, which act to slow the train.

Locomotive 10 uses a blended braking system, which means that the braking effort is a mix between electric (supplied by traction motors) and friction braking (by disc and tread). Braking by traction motors 114,116,118,120 is limited to 2600 kW by the DC power bus. By relying on traction motors 114, 116, 118, 120 to provide a significant portion of the braking power for locomotive 10, the brake pads and shoes on each of wheels 16 maybe conserved.

Figure 16:
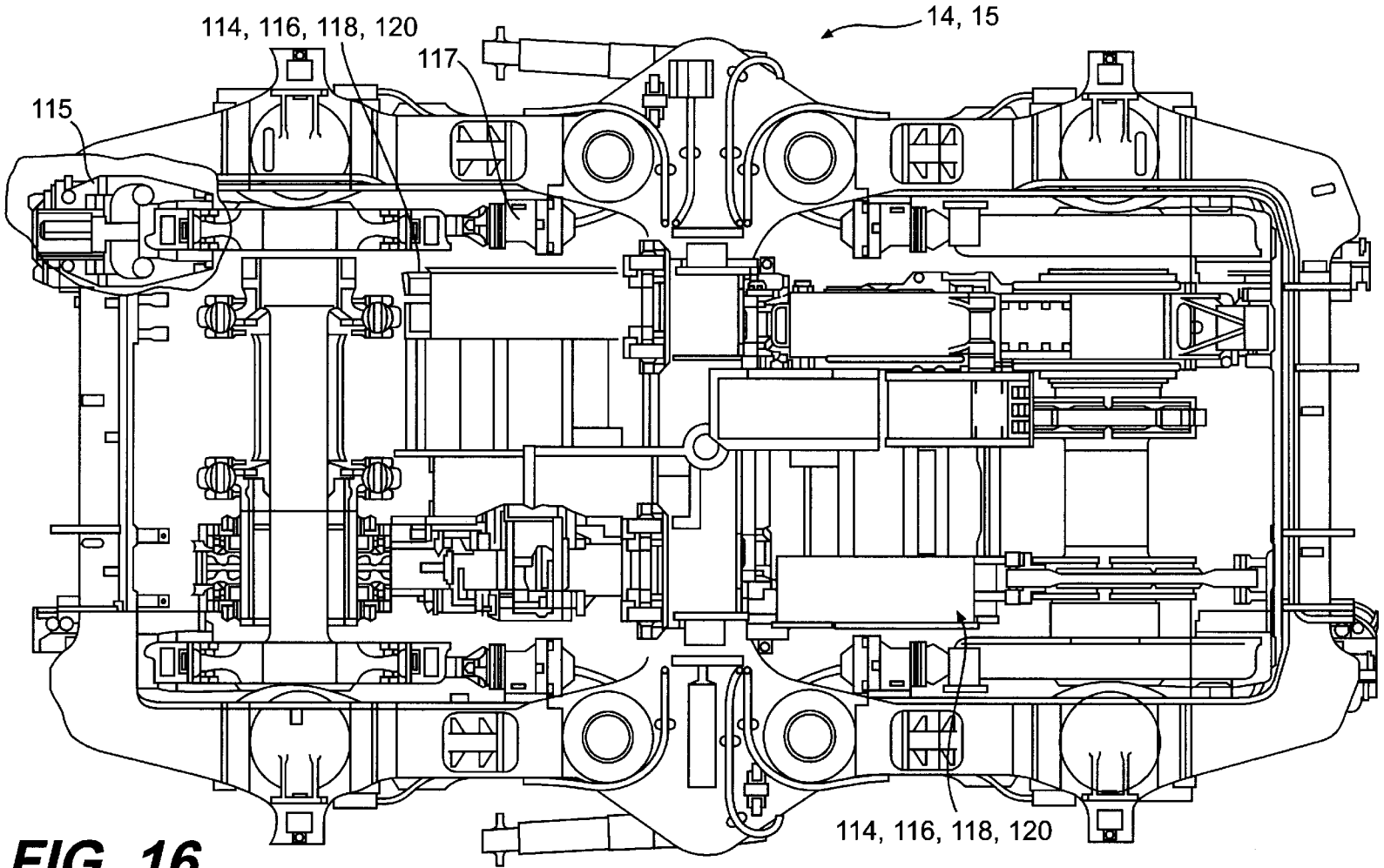
FIG. 16 is a top view of a truck of the present invention, showing the location of the traction motors thereon.
Figure 17:
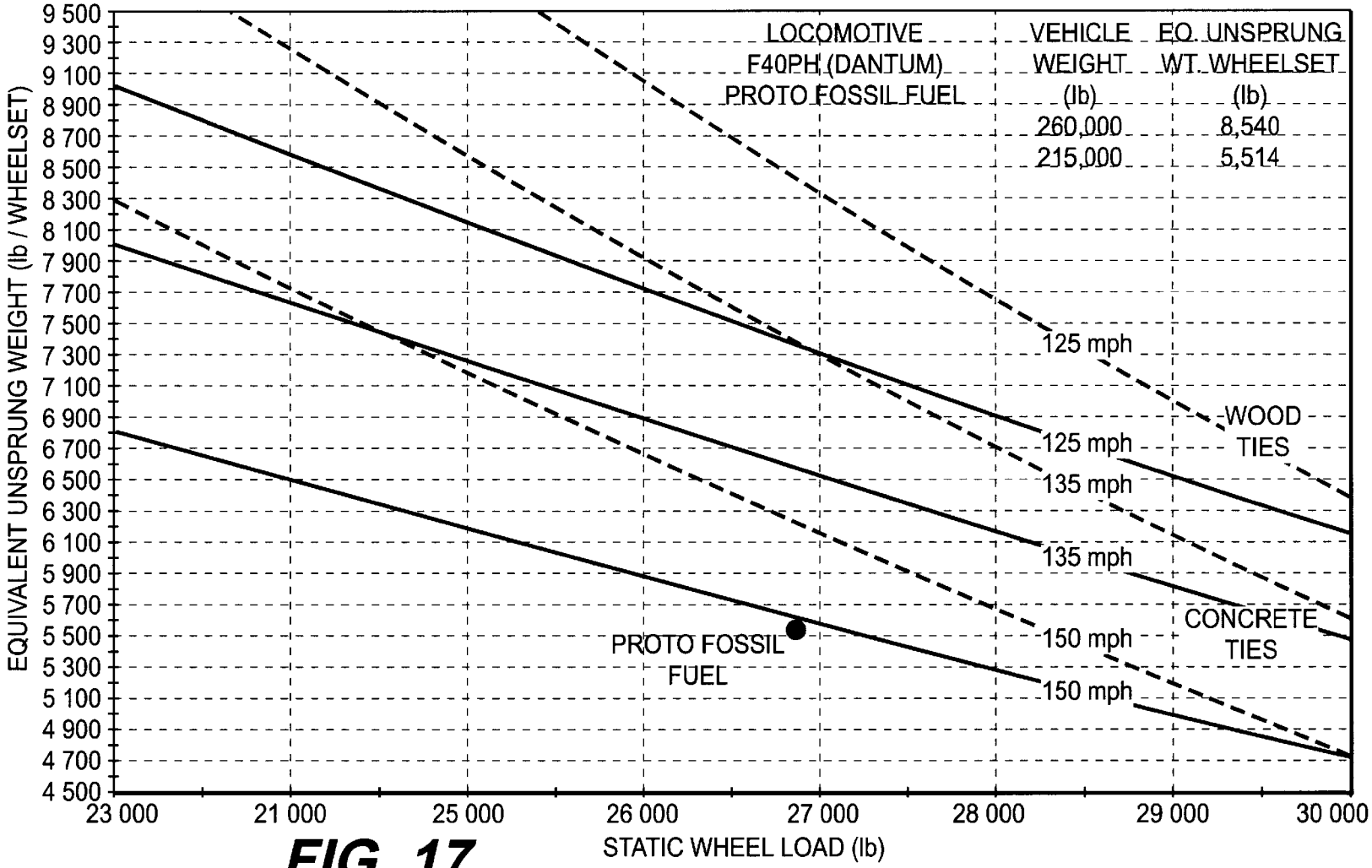
FIG. 17 is a graph illustrating the allowable speed for limiting the P2 forces on the rails, showing the relationship between the equivalent unsprung weight and the static wheel load of the locomotive.

If greater braking power is needed than can be provided by traction motors 114, 116, 118, 120, each of wheels 16 are provided with disc brakes 115 and tread brakes 117 that operate together to slow the train. The disc brakes 115 operate in the same manner as disc brakes on a car (or other vehicle) by applying braking power through brake pads to either side of the disks located inside of wheel 16. The tread brake 117 applies braking power, through a brake shoe, to a surface portion of the wheel not in contact with the rails, as shown in FIG. 16.

Gearbox 42, which is connected to turbine 44, preferably is a single input, dual output gearbox that transmits the full-rated output power of turbine 44 to the two alternators 40 that are part of the propulsion system. Gearbox 42 offers the appropriate reduction ratio to adapt the nominal turbine output speed to the alternator speed. Gearbox 42 has its own independent lubrication system, filtration, and cooling system.

Gearbox 42 cooling is done in two stages. The first stage includes an oil/fuel heat exchanger that can be used to pre-heat the fuel, if needed, to achieve the appropriate viscosity for turbine 44. The second stage of cooling for oil in gearbox 42 is accomplished by oil cooler 48, which is a heat exchanger mounted below roof 50 of locomotive 10. Oil cooler 48, which can cool the lubrication oil for both gearbox 42 and turbine 44, relies on ambient air to cool the lubrication oil supplied to gearbox 42 and/or turbine 44. Oil cooler 48 is an air/oil heat exchanger and may have two separate components, one heat exchanger for the turbine lubrication oil and a second heat exchanger for the gearbox lubrication oil. Air heated within the turbine/gearbox oil cooler 48 is exhausted to the environment.

Flexible couplings 41 (FIG. 10) connect the shafts from gearbox 42 to alternators 40. The clutch-type couplings 41 transmit the output torque and power of turbine 44 and absorb any misalignments associated with installation tolerances and the deflection of the locomotive chassis in service. The couplings 41 also protect the turbine shaft, in case of a short-circuit or malfunction on the electrical side of the system.

Inertial filters and silencer 52 are disposed above turbine 44. Inertial filters and silencer 52 are disposed on roof 50 of locomotive 10. Inertial filters and silencer 52 provide two functions as the name suggests. Air is drawn from the top and sides of locomotive 10 and is drawn through primary, inertial filters 52, which incorporate materials to minimize the noise generated by turbine 44. Inertial filters 52 separate particular material from the air by centrifuging the particulate matter (in a cyclone centrifuge) as the air passes therethrough. The air then travels through secondary filters 54 that are positioned just below inertial filters 52, above turbine 44, within enclosure assembly 46. Secondary filters 54 preferably are paper-type filters that remove most of the debris remaining in the air stream after inertial filters 52.

In the most preferred embodiment of the present invention, the combination of inertial filters 52 and secondary filters 54 removes 99.9% of particular material (when tested with AC Course Dust at maximum air flow condition) from the air stream to prevent fouling or wear of the engine components of turbine 44. However, a 99.9% removal of particulate material is not required to practice the present invention. To minimize wear on the engine components, it is preferred that at least 95% of particulate material be removed from the air prior to its ingestion by turbine 44. It is more preferred that about 97% or more of the particulate material be removed from the air for operation of locomotive 10. It is still more preferred that the combination of filters 52, 54 remove about 99% or more of the particulate material from the air prior to intake into turbine 44.

While it is preferred that inertial filters 52 be centrifugal filters, it should be recognized that any suitable alternative could be substituted for inertial filters 52 without departing from the scope of the present invention. Similarly, while it is preferred that secondary filters 54 be paper filters to simplify their replacement and reduce their cost, materials other than paper could be used without departing from the scope of the present invention.

Turbine 44 requires about 25,000 cubic feet per minute (c.f.m.) of air to operate effectively. Given that the interior space of enclosure assembly 46 is only about 4 cubic meters ($m^3$), and given the air flow requirements of turbine 44, the air in enclosure assembly 46 will be changed several times every second. This means that the temperature of the air in enclosure assembly 46 will not usually exceed more than ten degrees Fahrenheit (10° F.) above the ambient air temperature, simply because the air does not reside in enclosure assembly 46 long enough to become substantially heated. While no more than a ten degree difference is the most preferred embodiment of the present invention, enclosure assembly 10 can be constructed with a larger enclosed space so that other temperature differentials are possible without departing from the scope of the present invention. For example, enclosure assembly 46 can be constructed so that there is no more than 15 or 20 degree (Fahrenheit) temperature difference between the air in enclosure assembly 46 and ambient temperature. However, as the temperature difference increases, the efficiency of turbine 44 decreases.

Enclosure assembly 46, therefore, provides several significant advantages to the construction of locomotive 10. First, because the filters 54 are incorporated into enclosure assembly 46, there is no need for a separate series of ducts to provide air to turbine inlet 68. This reduces the space occupied by the systems that support turbine 44. Second, because the air consumed by turbine 44 is the same air that cools turbine 44, there is no need for a separate cooling or fan system for turbine 44. This eliminates the weight, complexity, cost, and energy requirements of providing a separate fan cooling system. This further reduces the total volume that turbine 44 and its support systems occupy on locomotive 10, which further reduces the weight, complexity, cost, and energy requirements of locomotive 10.

In addition to the advantages pointed out above, the design of enclosure assembly 46 has at least one further advantage. It is constructed from noise-absorbing materials, which are known to those skilled in the art, to minimize the noise pollution generated by turbine 44, its support systems, and its associated equipment. Specifically, the walls of enclosure assembly 46 and the walls surrounding exhaust duct 56 (and exhaust collector box 84) are provided with noise insulation that absorbs as much of the noise generated by turbine 44 as possible. The insulation and other noise reduction features are designed to meet standards for quietness, which is particularly important when locomotive 10 is at a railway station.

After the air passes through secondary filters 54, it enters turbine 44. Turbine 44 is situated within enclosure assembly 46 so that inlet 68 is facing toward the floor of enclosure assembly 46 (the bell mouth assembly). Inlet 68 faces toward the front of locomotive and exhaust outlet 69 faces toward the rear of locomotive 10.

Figure 18:
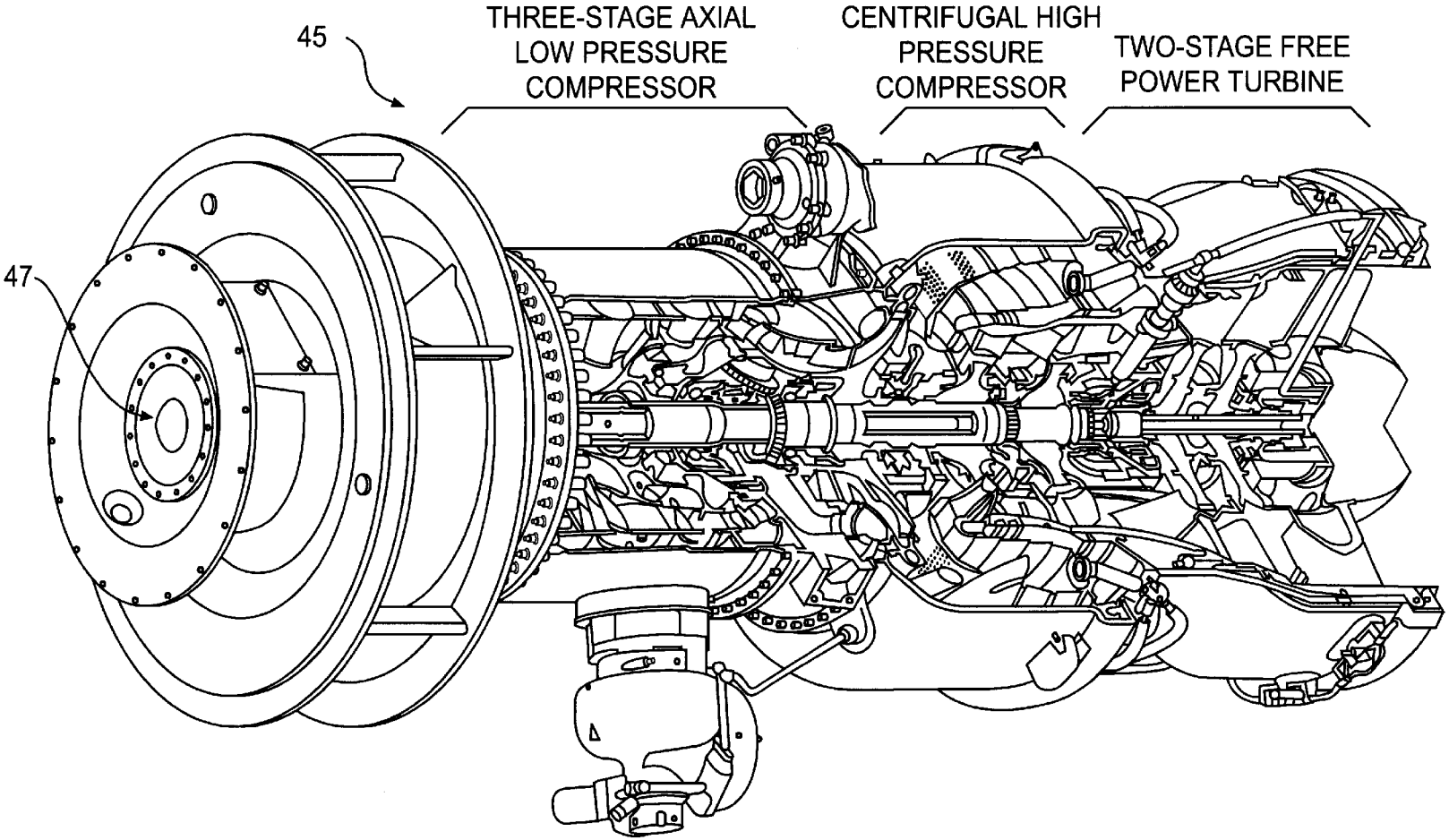
FIG. 18 is a cross-section of an alternate embodiment of the turbine for the present invention.

While the bell mouth configuration is one preferred embodiment for turbine 44, the turbine can be installed in enclosure assembly 46 without the bell mouth configuration. In the alternate configuration, turbine 45 FIG. 18) is provided with a radial air intake 47, which has an inlet opening all around the turbine. Regardless of the inlet configuration selected, it should be noted that either configuration is equally useable for the locomotive of the present invention without deviating from the scope of the present invention.

The rear end of turbine 44 is connected to an exhaust collector box 84, which connects to turbine exhaust duct 56. Turbine exhaust duct 56 extends upwardly from the top of exhaust collector box 84 toward roof 50. Turbine exhaust duct 56 connects with an exhaust silencer 58 that extends rearwardly from duct 56 toward the rear of the locomotive along roof 50. Preferably, the tail end of exhaust silencer 58 is divided into two or more separate, parallel paths. Among other things, this arrangement helps to force the hot exhaust gases generated by turbine 44 away from the catenary wire (if present) to prevent overheating of the catenary wire when locomotive 10 is stationary.

Each of the components of locomotive 10 are arranged on frame 12 such that access passageways 60 and 62 extend along the length of locomotive 10 so that the engine components are accessible for maintenance from either side of locomotive 10. This construction simplifies maintenance of turbine 44 and the auxiliary systems that are connected to turbine 44 because there are full-sized access passageways on either side of turbine 44.

A fuel tank 63 is disposed below alternators 40 between forward and rearward trucks 14, 15. Fuel tank 63 is disposed below frame 12 and supplies the appropriate fuel for turbine 44. In the preferred embodiment, turbine 44 operates using standard diesel fuel. Fuel tank 63 is designed to hold approximately 2,200 U.S. gallons of diesel fuel and can be filled through inlet ports provided on either side of locomotive 10. Fuel tank 63 is designed to withstand the weight of locomotive 10. Furthermore, an environmental compartment in fuel tank 63 recuperates any fuel or oil spillage inside locomotive 10. A hot well section also can be provided to pre-heat the fuel, if necessary. A vent system (not shown in detail) designed into fuel tank 63 limits the possibility of fuel spillage.

While turbine 44 preferably utilizes diesel fuel to operate, it should be appreciated that any suitable fuel can be substituted for diesel fuel without departing from the scope of the present invention.

Enclosure assembly 46, which is described in greater detail in the paragraphs that follow, is illustrated in FIGS. 3–10.

Figure 3:
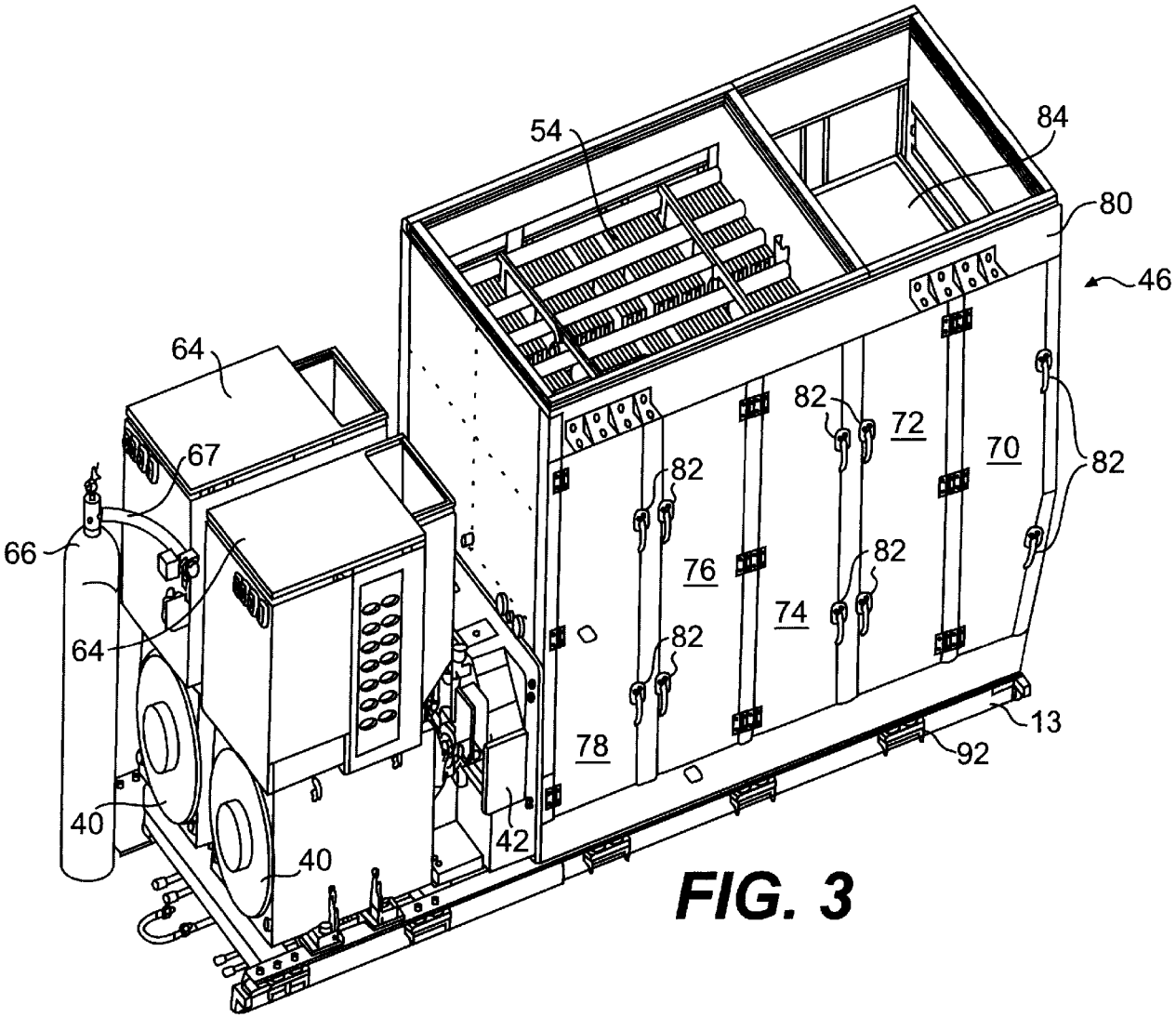
FIG. 3 is a perspective view of the enclosure assembly for the turbine power generator for the locomotive shown in FIGS. 1 and 2.
Figure 4:
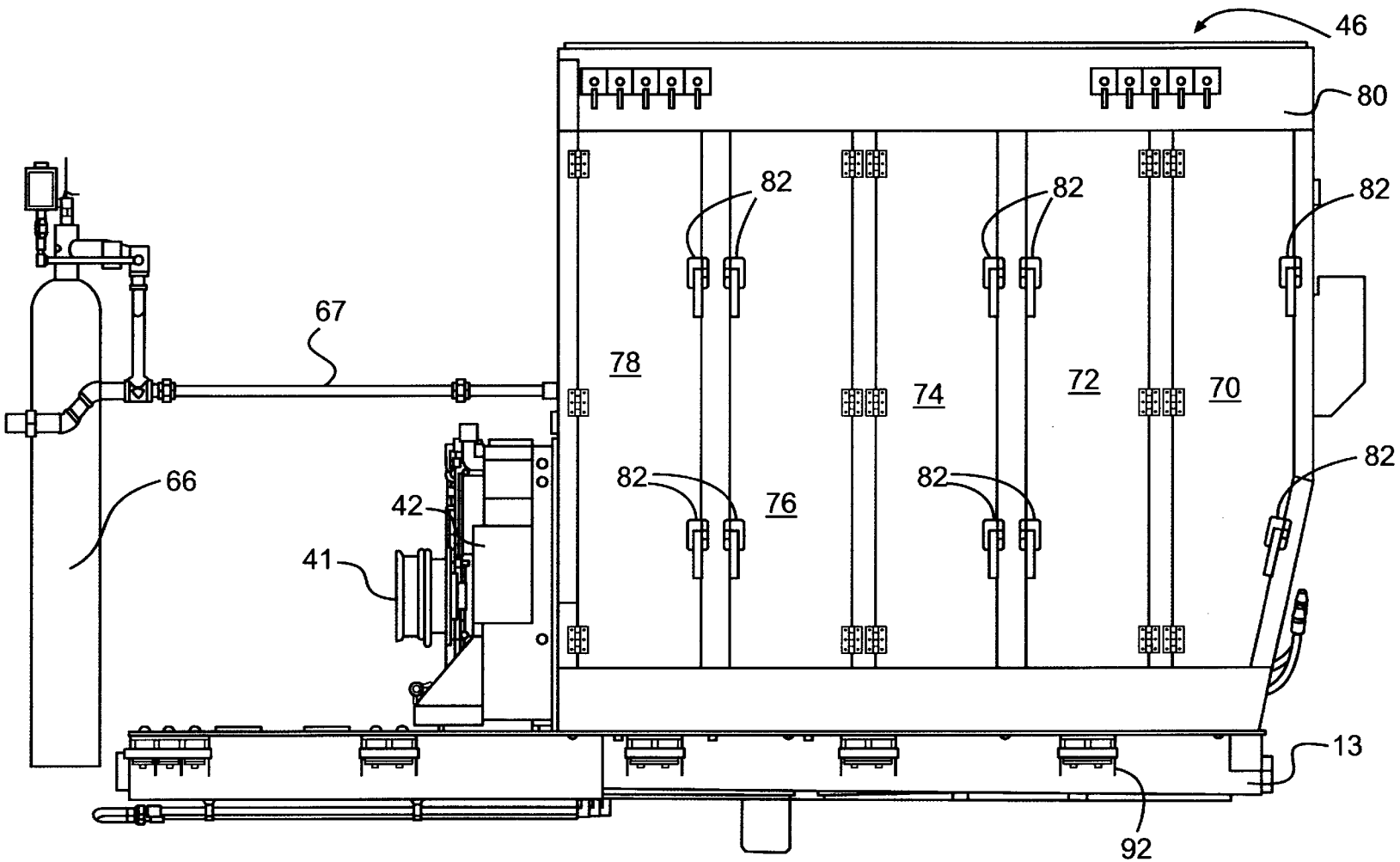
FIG. 4 is a side view illustration of the enclosure assembly illustrated in FIG. 3, with the alternators and alternator/rectifier blower assemblies removed to illustrate the construction of enclosure assembly in greater detail.

FIG. 3 illustrates a perspective view of enclosure assembly 46, which sits atop turbine generator platform 13 (with the rear of enclosure assembly facing to the right of the figure). Turbine generator platform 13 sits atop frame 12 and is connected to frame 12 through shock mount installations 92. Shock mount installations 92 dampen the forces transmitted from frame 12 to turbine generator platform 13 and vice versa.

Gearbox 42 is also shown in FIG. 3 along with alternators 40, all of which are disposed on turbine generator platform 13. Alternator/rectifier blower assemblies 64 are shown positioned atop alternators 40. Blower assemblies 64 blow cooling air across alternators 40 to assure that they operate within tolerable temperature limits.

An FE13 fire suppression cylinder 66 is also shown in FIG. 3. Fire suppression cylinder 66 connects to enclosure assembly 46 through piping 67, which is shown in greater detail in FIGS. 4 and 5. Fire suppression cylinder 66, which is physically located in the fuel and oil rack assembly 38, provides fire suppression agent to the interior of enclosure assembly 46, should turbine 44 catch on fire during operation. The fire suppression agent is commonly referred to as FE13, which is a commercial name for 3-fluoro-methane. One advantage offered by turbine enclosure 46, at least as it relates to the fire suppression system, is that the enclosed space (of 4 $m^3$) is small. As a result, locomotive 10 need not carry a large volume of FE13 fire suppression agent to put out a fire in turbine 44.

FIG. 3 also illustrates the position of secondary filters 54 above turbine 44. In addition, FIG. 3 illustrates the position of exhaust collector box 84 within enclosure assembly 46.

Five removable doors 70, 72, 74, 76, and 78, disposed along a side wall 80 of enclosure assembly 46, are also shown in FIG. 3. Removable doors 70–78 can be opened or removed to provide assess to turbine 44 so that turbine 44 can be serviced, maintained, and repaired as necessary. A second set of doors (not shown) are positioned on the wall opposite from wall 80 (shown in FIG. 3). Doors 70–78 are alarmed so that, if one of the doors is opened, turbine 44 automatically shuts down. This guarantees the safety of personnel standing in passageways 60, 62, because of the large volume of air drawn into turbine 44.

Not only may doors 70–78 be removed from wall 80, it is also possible to remove some of the door posts to provide still greater accessibility to turbine 44.

The alarm on doors 70–78 (and the corresponding bank of doors on the opposite side of enclosure assembly 46) is actuated by a sensor that detects the pressure differential between the ambient air pressure in passageways 60, 62 and the air pressure within enclosure assembly 46. If the sensor (s) detect that there is little or no pressure differential between passageways 60, 62 and the interior of enclosure assembly 46, this indicates that one of the doors 70–78 has been opened. The sensor(s) then send a shut-down signal to turbine 44.

Each of doors 70–78 is hingedly mounted to wall 80 and is provided with two latching handles 82 to seal doors 70–78 closed. This arrangement is also shown in detail in FIG. 4. The opposite side of enclosure assembly 46 is essentially a mirror image of the view shown in FIG. 4.

Figure 5:
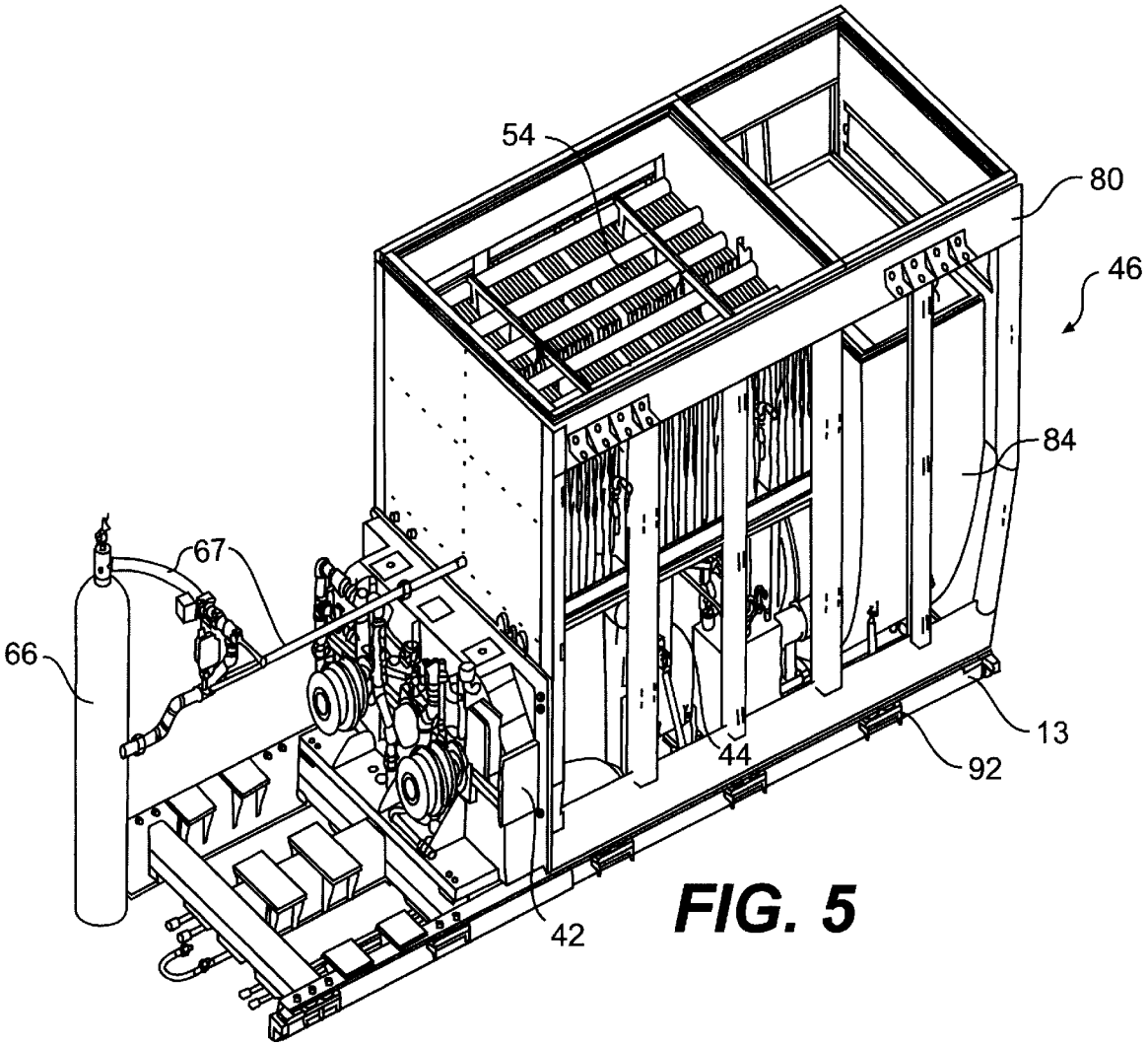
FIG. 5 is a perspective view of a portion of the enclosure assembly depicted in FIGS. 3 and 4, with the alternator/rectifier blower assembly and the removable maintenance access doors removed to reveal further details of the structure of the enclosure assembly.

FIG. 5 is a perspective view of enclosure assembly 46 with doors 70–78 removed to expose the components within enclosure assembly 46. The exhaust collector box 84, which is the lowest-most section of exhaust duct 56, is shown at the rear of enclosure assembly 46. In addition, the placement of secondary filters 54 is also shown.

Figure 6:
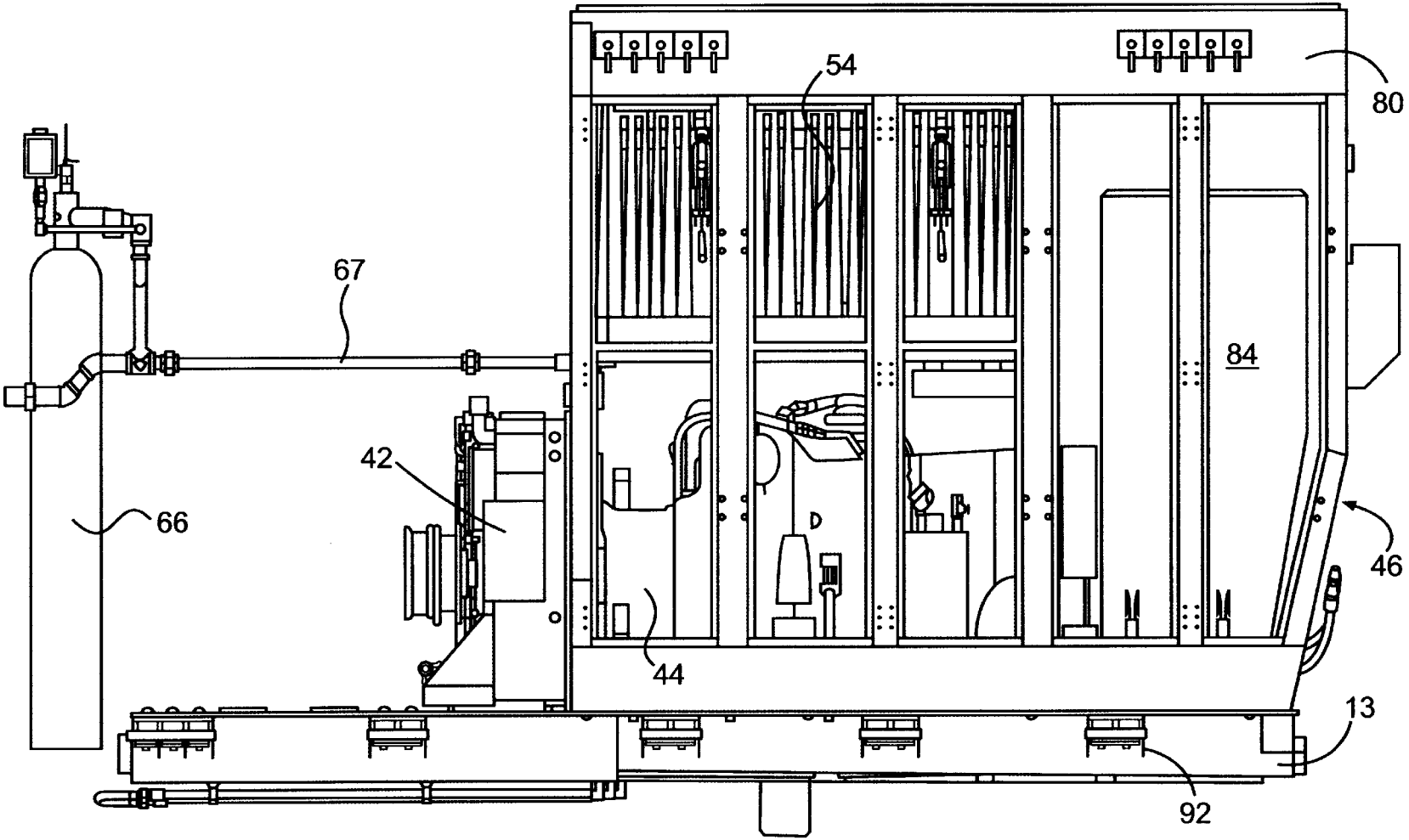
FIG. 6 is a side view of the portion of the enclosure assembly depicted in FIG. 5.

FIG. 6 is a side-view illustration of enclosure assembly 46 as illustrated in FIG. 5.

Figure 7:
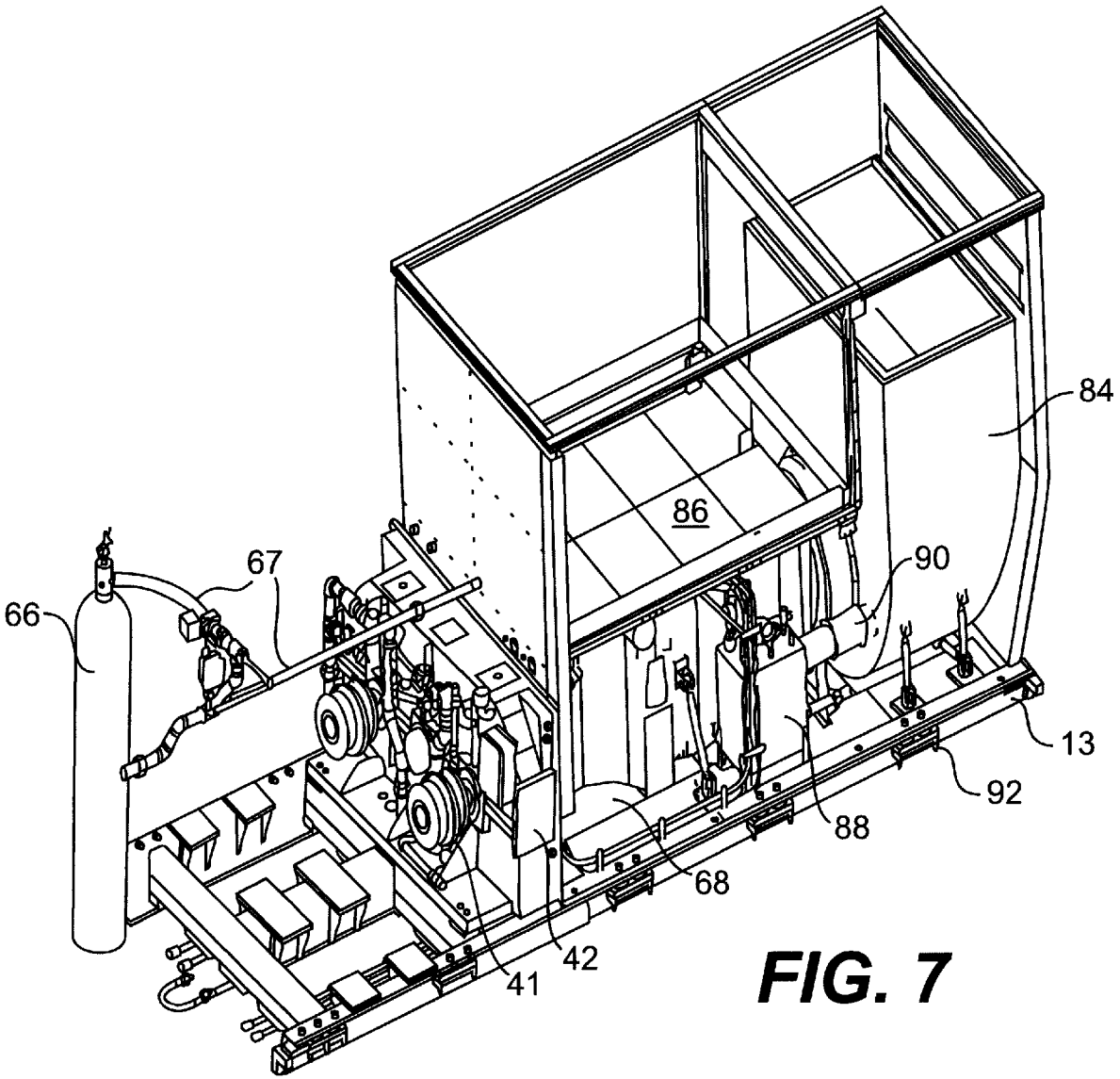
FIG. 7 is a perspective view of a portion of the enclosure assembly depicted in FIGS. 5 and 6, with the secondary filtration system and the outer walls removed to reveal still further details of the structure of the enclosure assembly.
Figure 8:
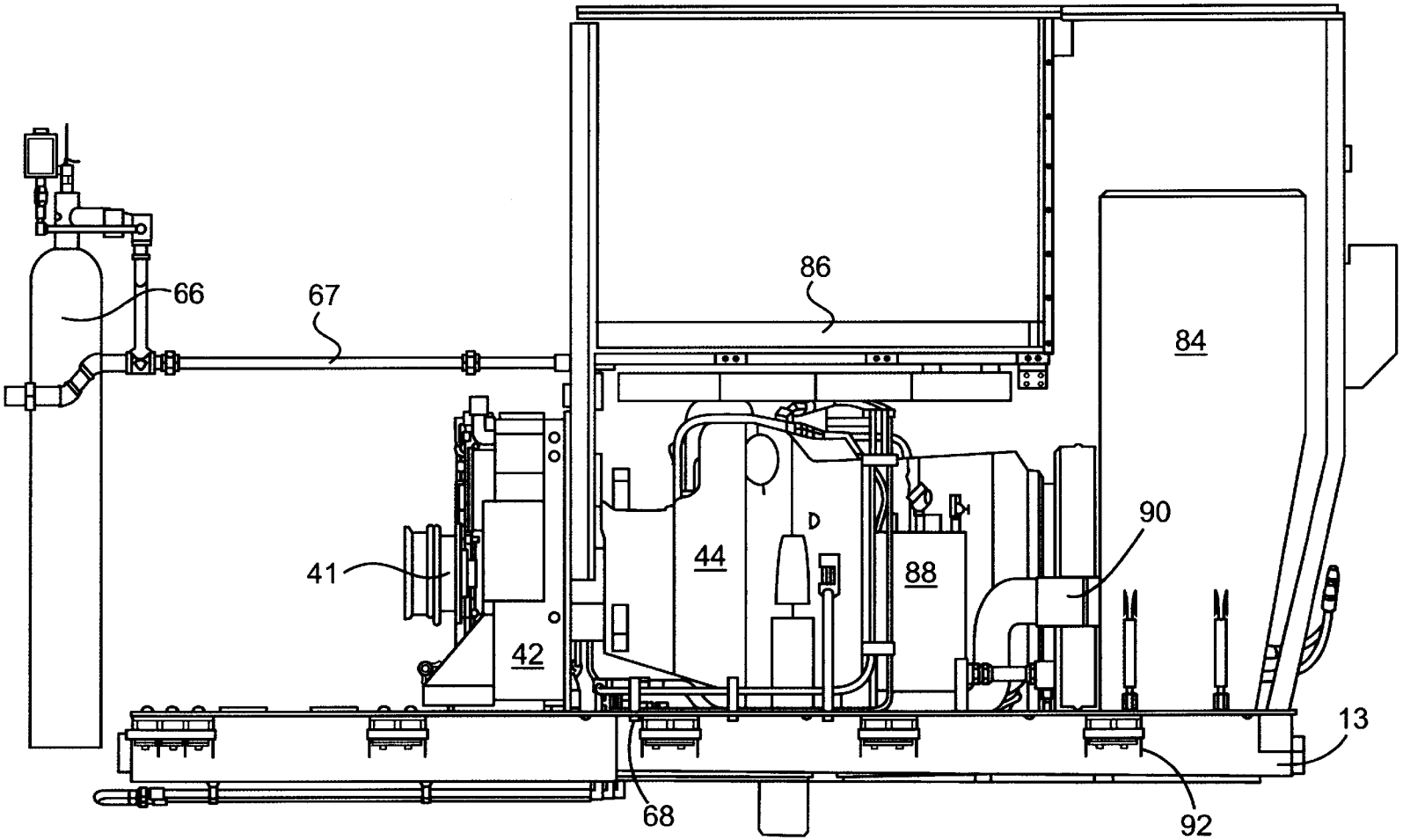
FIG. 8 is a side view illustration of the portion of the enclosure assembly depicted in FIG. 7.

FIG. 7 is a perspective view of enclosure assembly 46, with side wall 80 removed to reveal still further features of the present invention. Below secondary filters 54 (which have been removed from the view illustrated in FIG. 7), an acoustic shield 86 is positioned just above turbine 44 to assist in reducing the noise generated by turbine 44. The couplings 41 between gearbox 42 and alternators 40 are also shown in greater detail.

FIG. 7 also shows the location of the turbine air inlet area 68 (also referred to as the bell mouth configuration because of its shape). The location of the turbine oil system 88 is also illustrated. A bleed pipe 90, extending between turbine oil system 88 and exhaust collector box 84 is also shown.

Figure 9:
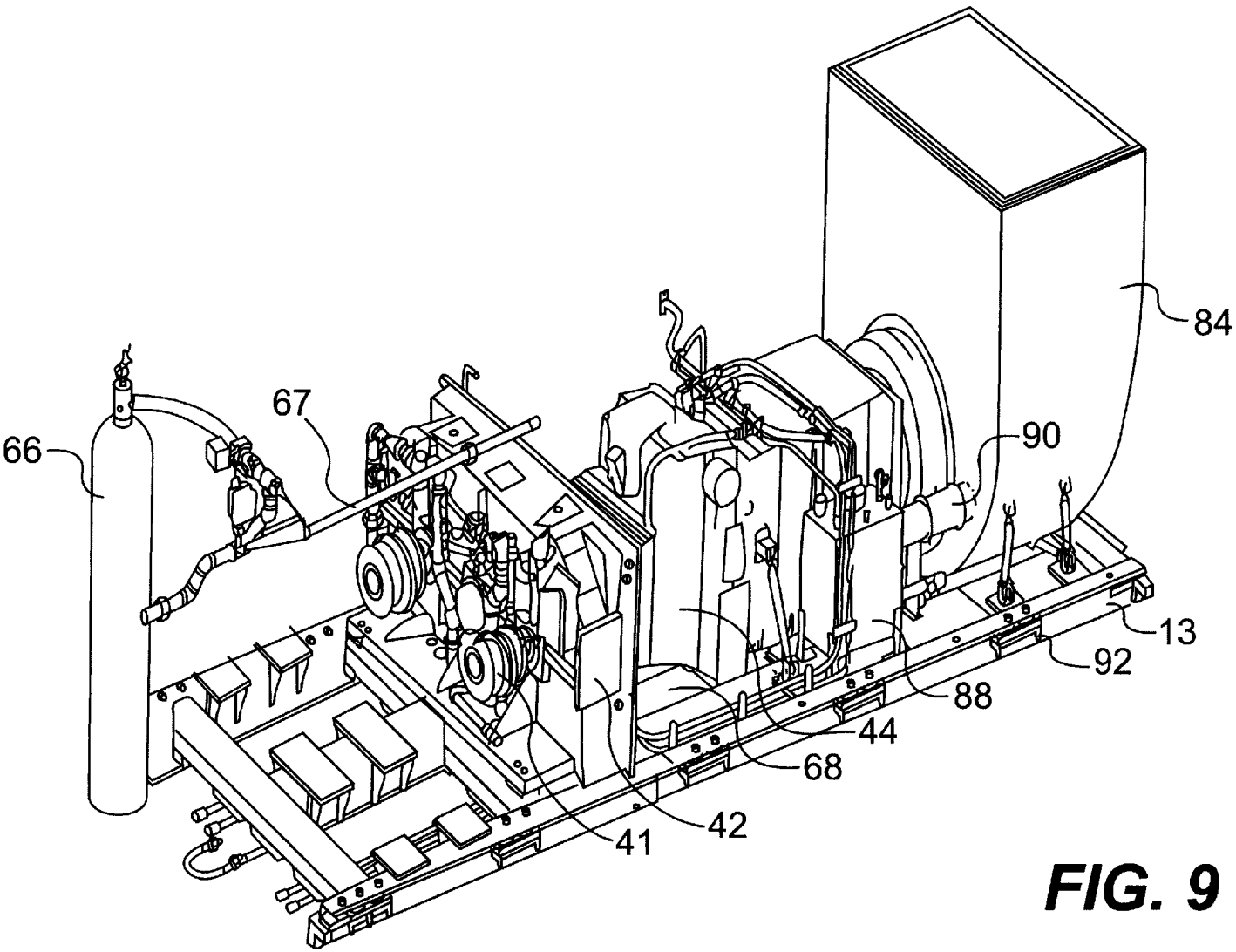
FIG. 9 is a perspective illustration of a portion of the enclosure assembly shown in FIGS. 7 and 8, with the structural supports surrounding the turbine generator removed to reveal still further details of the structure of the enclosure assembly.
Figure 10:
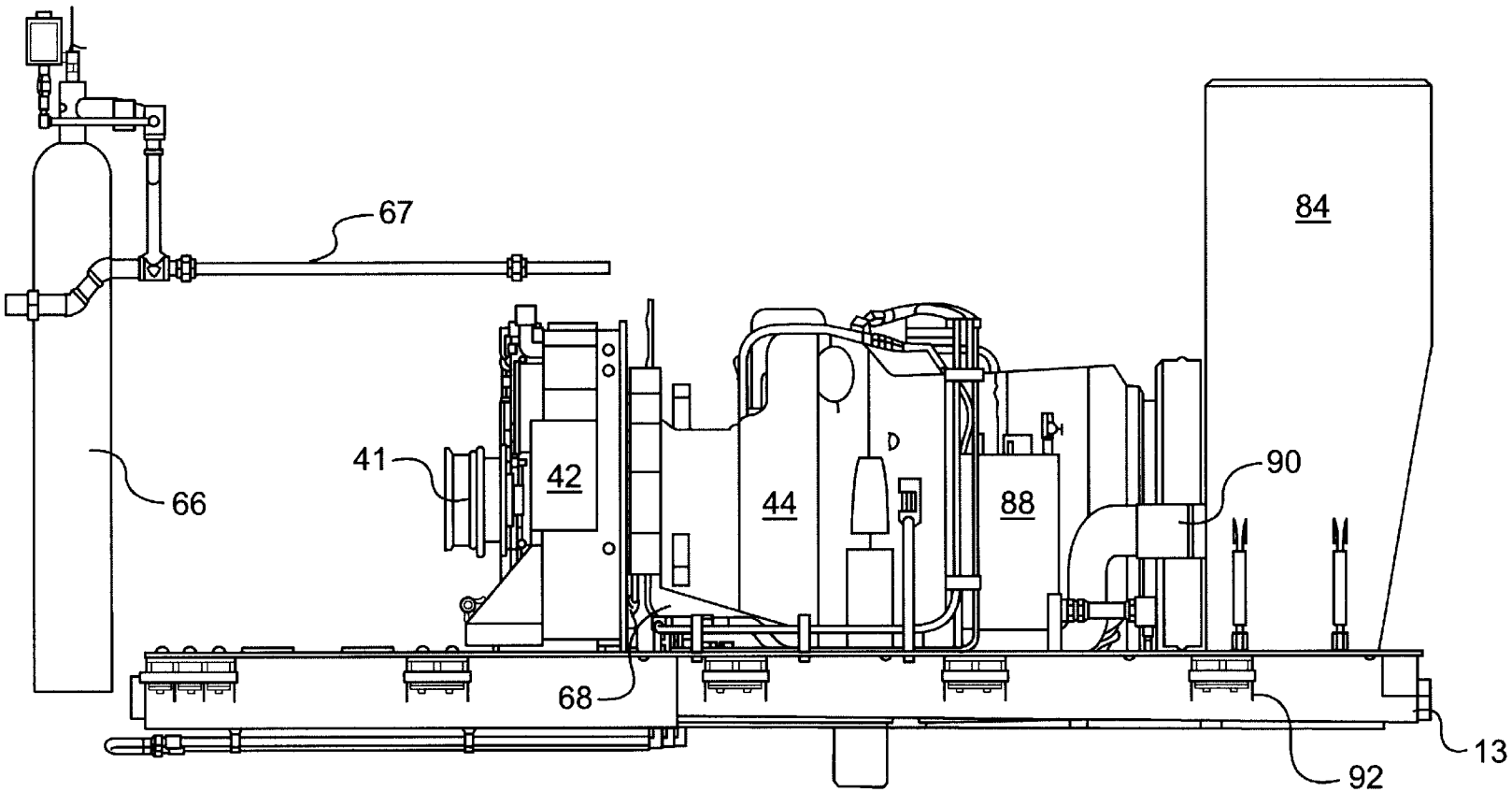
FIG. 10 is a side view illustration of the portion of the enclosure assembly depicted in FIG. 9.

FIGS. 9 and 10 are further illustrations of enclosure assembly 46 with still further details removed from previous illustrations to clarify the positioning of the various elements within enclosure assembly 46.

As mentioned above, a conventional locomotive is very heavy and exerts a considerable amount of force on the rails over which it travels. Because locomotive 10 of the present invention offers a considerably lighter (in weight) alternative to the conventional locomotive, it offers a design that can operate at higher speeds while reducing overall the forces (otherwise referred to as P2 forces) exerted on conventional rails. The following table, Table #1, summarizes how locomotive 10 of the present invention exerts less force on the rails than the conventional locomotive, even though locomotive 10 can operate at much higher speeds.

TABLE #1

| | Conventional Locomotive (F40 Locomotive) | Present Invention |
|---|---|---|
| Vehicle Weight | 260,000 lbs. | 215,000 lbs. |
| Unsprung Weight | 8,540 lb./axle | 5,514 lb./axle |
| Force (P2) on Rails | | |
| Wooden Ties | 47,395 lb. | 45,984 lb. |
| Concrete Ties | 54,182 lb. | 53,862 lb. |
| Operating Speed | 90 mph | 150 mph |

Figure 12:
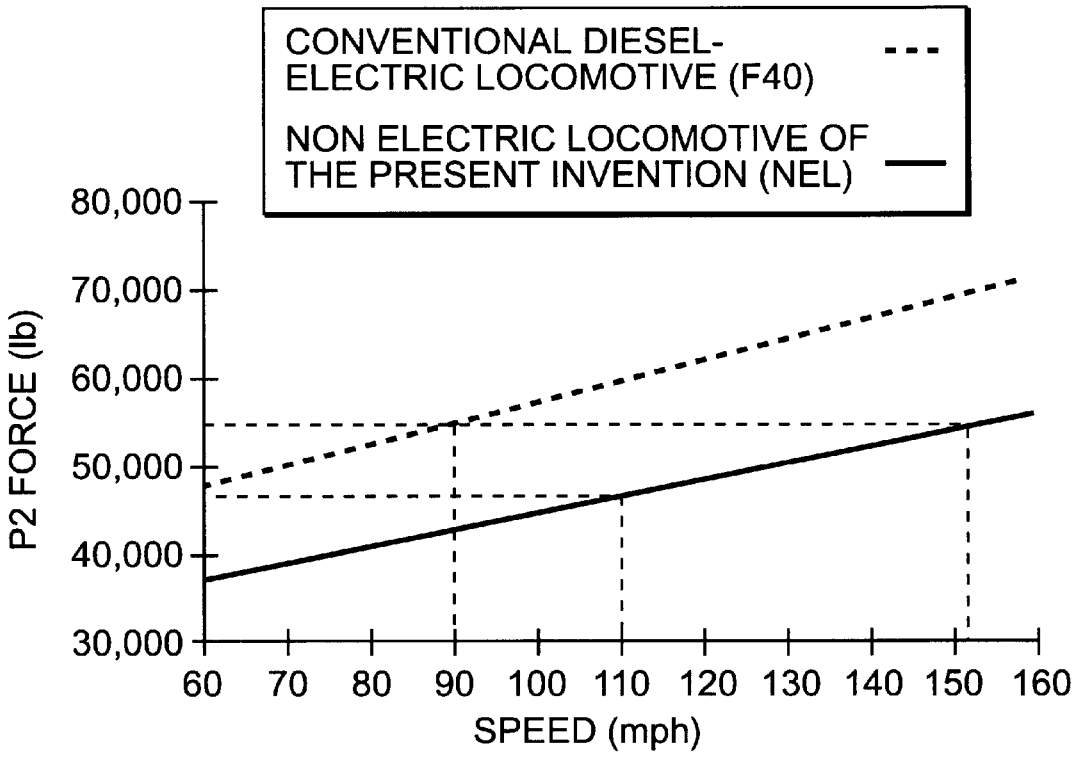
FIG. 12 is a graphical comparison between the dynamic forces exerted on the rails by the locomotive of the present invention and the dynamic forces exerted on the rails by a diesel-electric locomotive of the type known in the prior art.

As Table #1 indicates, locomotive 10 can operate at greater speeds (i.e., up to 150 mp.h.) than a conventional diesel-electric locomotive (an F40 locomotive) without exerting greater forces on the rails than the conventional locomotive at 90 m.p.h. This is true throughout the entire speed range for locomotive 10, as is illustrated in FIG. 12.

The reduction in P2 forces on the rails by locomotive 10 largely results from incorporating a power generator (namely, turbine 44) that is about 35,000 lbs. lighter than the diesel-electric generator of the conventional F40 locomotive. The reduction in unsprung weight is also significant in reducing the P2 forces exerted by locomotive 10 on the rails over which it travels. As indicated in Table #1, the unsprung weight of locomotive 10 has been reduced by 3,000 lbs./axle by comparison with the conventional F40 diesel-electric locomotive.

It should be noted that the 215,000 lb. weight of locomotive 10, which is set forth in Table #1, is the weight of locomotive 10 when it has been fueled and is ready for operation. The 2,200 U.S. gallons of diesel fuel in fuel tank 63 accounts for more than 15,000 lbs. of this weight. Some additional weight is also attributable to lubricants and coolants that are also supplied to locomotive 10 so that the locomotive may operate. As a result, when locomotive 10 has not been fueled (or is not ready for operation), it weighs just less than 200,000 lbs.

As would be appreciated by those skilled in the art, however, a fully-fueled weight of 215,000 lbs. is not the only weight possible to practice the present invention. For example, as mentioned, if gearbox 42 is removed and alternators 40 are replaced by a single alternator that is directly connected to turbine 44, the weight of locomotive 10 can be reduced by an additional 10,000 lbs.

It is preferred that the locomotive of the present invention, when ready for operation, weigh no more than 225,000 lbs. It is more preferred that the locomotive of the present invention, when ready for operation, weigh no more than about 215,000 lbs. It is most preferred that the locomotive of the present invention, when ready for operation, weigh less than about 200,000 lbs. As mentioned, the lighter locomotive 10 is, the smaller will be the dynamic forces (P2) exerted on the rails over which it travels. For example, as shown in FIG. 12, if locomotive 10 is kept to a weight of less than 215,000 lbs., it exerts dynamic forces on the rails that are less than those exerted by the conventional F40 locomotive throughout its speed range.

Similarly, since the unsprung weight also contributes to the dynamic forces on the rails, it is preferred that the unsprung mass for locomotive 10 be no more than about 6,500 lbs./axle. It is even more preferred that the unsprung mass not exceed 6,000 lbs./axle. An even greater preference is for the unsprung mass not to exceed 5,500 lbs./axle. Finally, an even greater preference exists for the locomotive's unsprung weight not to be greater than about 5,000 lbs./axle. The smaller the unsprung mass, the lower the dynamic forces (P2) exerted on the rails.

The P2 forces exerted on the rails takes into account the weight of the locomotive, its unsprung weight, and the type of tie that holds the rails in place. The difference in P2 forces between the wooden and concrete ties can be explained by the different tie spacing for each configuration.

As would be understood by those skilled in the art, the present invention is not limited solely to the embodiments described herein. Equivalents to the embodiments described, which fall within the scope of the preceding description, are also intended to fall within the scope of the claims appended hereto.

What is claimed is:

1. An enclosure assembly for a turbine generator for a locomotive, comprising:

a wall with a roof and floor defining an enclosed space adapted to receive a turbine engine;

an air inlet permitting ingress of air into the enclosed space so that the turbine ingests the air from the enclosed space and the air circulates around the turbine within the enclosed space to cool the turbine;

an exhaust duct, adapted to be connected to the exhaust outlet of the turbine, permitting egress of exhaust gases generated by the turbine from the enclosed space; and a silencer, connected to the exhaust duct, to minimize noise generated by the turbine, wherein at least one of the wall, roof, and floor incorporate noise dampening materials to minimize noise generated by the turbine.

2. The enclosure assembly of claim 1, further comprising:

an air filter disposed between the air inlet and the turbine for removing particulate material from the air prior to ingestion by the turbine.

3. The enclosure assembly of claim 2, wherein the air filter comprises:

a paper filter assembly, disposed after an inertial filter assembly exterior to the enclosure, for removing particulate material from the air that was not removed by the inertial filter assembly.

4. The enclosure assembly of claim 3, wherein the air filter removes more than about 95% of the particulate material from the air prior to ingestion by the turbine.

5. The enclosure assembly of claim 3, wherein the air filter removes more than about 97% of the particulate material from the air prior to ingestion by the turbine.

6. The enclosure assembly of claim 3, wherein the air filter removes more than about 99% of the particulate material from the air prior to ingestion by the turbine.

7. The enclosure assembly of claim 3, wherein the air filter removes about 99.9% of the particulate material from the air prior to ingestion by the turbine.

8. The enclosure assembly of claim 1, wherein, during operation of the turbine, the air in the enclosed space remains within a temperature no greater than about 20° F. above ambient temperature due to the volume of air ingested by the turbine.

9. The enclosure assembly of claim 1, wherein, during operation of the turbine, the air in the enclosed space remains within a temperature no greater than about 15° F. above ambient temperature due to the volume of air ingested by the turbine.

10. The enclosure assembly of claim 1, wherein, during operation of the turbine, the air in the enclosed space remains within a temperature no greater than about 10° F. above ambient temperature due to the volume of air ingested by the turbine.

11. The enclosure assembly of claim 1, wherein the enclosed space is adapted to receive a turbine weighing no more than about 5,000 lbs.

12. The enclosure assembly of claim 1, wherein the enclosed space is adapted to receive a turbine weighing no more than about 4,000 lbs.

13. The enclosure assembly of claim 1, wherein the enclosed space is adapted to receive a turbine weighing no more than about 3,000 lbs.

14. The enclosure assembly of claim 1, wherein the enclosed space is adapted to receive a turbine weighing no more than about 2,000 lbs.

15. The enclosure assembly of claim 1, wherein the enclosed space is adapted to receive a turbine weighing no more than about 1,500 lbs.

16. The enclosure assembly of claim 1, wherein the enclosed space is adapted to receive a turbine weighing about 1,200 lbs.

17. The enclosure assembly of claim 1, wherein the turbine is at least a double shaft engine.

18. The enclosure assembly of claim 1, wherein the turbine is at least a triple shaft engine.

19. The enclosure assembly of claim 1, wherein the turbine is a triple shaft engine with a three-stage axial low pressure compressor, one centrifugal high pressure compressor, and a two-stage free power turbine.

20. A locomotive, comprising:

a frame;

a wall with a roof and floor defining an enclosed space on the frame;

a turbine engine disposed within the enclosed space;

an air inlet permitting ingress of air into the enclosed space so that the turbine ingests the air from the enclosed space and the air circulates around the turbine within the enclosed space to cool the turbine;

an exhaust duct, adapted to be connected to the exhaust outlet of the turbine, permitting egress of exhaust gases generated by the turbine from the enclosed space; and a silencer, connected to the exhaust duct, to minimize noise generated by the turbine, wherein at least one of the wall, roof, and floor incorporate noise dampening materials to minimize noise generated by the turbine.

21. The locomotive of claim 20, further comprising:

an air filter disposed between the air inlet and the turbine for removing particulate material from the air prior to ingestion by the turbine.

22. The locomotive of claim 21, wherein the air filter comprises:

a paper filter assembly, disposed after an inertial filter assembly exterior to the enclosure, for removing particulate material from the air that was not removed by the inertial filter assembly.

23. The locomotive of claim 22, wherein the air filter removes about 95% of the particulate material from the air prior to ingestion by the turbine.

24. The locomotive of claim 22, wherein the air filter removes about 97% of the particulate material from the air prior to ingestion by the turbine.

25. The locomotive of claim 22, wherein the air filter removes about 99% of the particulate material from the air prior to ingestion by the turbine.

26. The locomotive of claim 22, wherein the air filter removes about 99.9% of the particulate material from the air prior to ingestion by the turbine.

27. The locomotive of claim 20, wherein, during operation of the turbine, the air in the enclosed space remains within a temperature no greater than about 20° F. above ambient temperature due to the volume of air ingested by the turbine.

28. The locomotive of claim 20, wherein, during operation of the turbine, the air in the enclosed space remains within a temperature no greater than about 15° F. above ambient temperature due to the volume of air ingested by the turbine.

29. The locomotive of claim 20, wherein, during operation of the turbine, the air in the enclosed space remains within a temperature no greater than about 10° F. above ambient temperature due to the volume of air ingested by the turbine.

30. The locomotive of claim 20, wherein the enclosed space is adapted to receive a turbine weighing no more than about 5,000 lbs.

31. The locomotive of claim 20, wherein the enclosed space is adapted to receive a turbine weighing no more than about 4,000 lbs.

32. The locomotive of claim 20, wherein the enclosed space is adapted to receive a turbine weighing no more than about 3,000 lbs.

33. The locomotive of claim 20, wherein the enclosed space is adapted to receive a turbine weighing no more than about 2,000 lbs.

34. The locomotive of claim 20, wherein the enclosed space is adapted to receive a turbine weighing no more than about 1,500 lbs.

35. The locomotive of claim 20, wherein the enclosed space is adapted to receive a turbine weighing about 1,200 lbs.

36. The locomotive of claim 20, wherein the turbine is at least a double shaft engine.

37. The locomotive of claim 20, wherein the turbine is at least a triple shaft engine.

38. The locomotive of claim 20, wherein the turbine is a triple shaft engine with a three-stage axial low pressure compressor, one centrifugal high pressure compressor, and a two-stage free power turbine.

39. The locomotive of claim 20, wherein the locomotive, when ready for operation, weighs no more than about 225,000 lbs.

40. The locomotive of claim 20, wherein the locomotive, when ready for operation, weighs no more than about 215,000 lbs.

41. The locomotive of claim 20, wherein the locomotive, when ready for operation, weighs no more than about 200,000 lbs.

42. The locomotive of claim 20, wherein the locomotive's unsprung weight is no more than about 6,500 lbs./axle.

43. The locomotive of claim 20, wherein the locomotive's unsprung weight is no more than about 6,000 lbs./axle.

44. The locomotive of claim 20, wherein the locomotive's unsprung weight is no more than about 5,500 lbs./axle.

45. The locomotive of claim 20, wherein the locomotive's unsprung weight is no more than about 5,000 lbs./axle.

46. The locomotive of claim 20, wherein dynamic forces exerted by the locomotive at greater than 150 m.p.h. are less than about 55,000 lbs.

47. The locomotive of claim 20, wherein dynamic forces exerted by the locomotive between 60 and 150 m.p.h. fall in a range between 35,000 and 55,000 lbs.

48. The enclosure assembly of claim 1, further comprising:

a second silencer disposed adjacent to the air inlet to minimize noise generated by the turbine.

49. The locomotive of claim 20, further comprising:

a second silencer disposed adjacent to the air inlet to minimize noise generated by the turbine.

50. An enclosure assembly for a locomotive, comprising:

a wall with a roof and floor defining an enclosed space;

a turbine engine disposed within the enclosed space, the turbine engine having an air inlet that draws air directly from the enclosed space, the turbine engine ingesting air from the enclosed space through the turbine engine air inlet, wherein the air also circulates around the turbine within the enclosed space to cool the turbine; and an exhaust duct, connected to an exhaust outlet of the turbine, permitting egress of exhaust gases generated by the turbine from the enclosed space.

51. The enclosure assembly of claim 50, further comprising:

an air inlet permitting air to enter the enclosed space; and an air filter disposed between the air inlet and the turbine for removing particulate material from the air prior to ingestion by the turbine.

52. The enclosure assembly of claim 51, wherein the air filter comprises:

a paper filter assembly for removing particulate material from the air.

53. The enclosure assembly of claim 52, wherein the air filter removes about 95% of the particulate material from the air prior to ingestion by the turbine.

54. The enclosure assembly of claim 52, wherein the air filter removes about 97% of the particulate material from the air prior to ingestion by the turbine.

55. The enclosure assembly of claim 52, wherein the air filter removes about 99% of the particulate material from the air prior to ingestion by the turbine.

56. The enclosure assembly of claim 52, wherein the air filter removes about 99.9% of the particulate material from the air prior to ingestion by the turbine.

57. The enclosure assembly of claim 50, wherein, during operation of the turbine, the air in the enclosed space remains within a temperature no greater than about 20° F. above ambient temperature due to the volume of air ingested by the turbine.

58. The enclosure assembly of claim 50, wherein, during operation of the turbine, the air in the enclosed space remains within a temperature no greater than about 15° F. above ambient temperature due to the volume of air ingested by the turbine.

59. The enclosure assembly of claim 50, wherein, during operation of the turbine, the air in the enclosed space remains within a temperature no greater than about 10° F. above ambient temperature due to the volume of air ingested by the turbine.

60. The enclosure assembly of claim 50, wherein the enclosed space is adapted to receive a turbine weighing no more than about 5,000 lbs.

61. The enclosure assembly of claim 50, wherein the enclosed space is adapted to receive a turbine weighing no more than about 4,000 lbs.

62. The enclosure assembly of claim 50, wherein the enclosed space is adapted to receive a turbine weighing no more than about 3,000 lbs.

63. The enclosure assembly of claim 50, wherein the enclosed space is adapted to receive a turbine weighing no more than about 2,000 lbs.

64. The enclosure assembly of claim 50, wherein the enclosed space is adapted to receive a turbine weighing no more than about 1,500 lbs.

65. The enclosure assembly of claim 50, wherein the enclosed space is adapted to receive a turbine weighing about 1,200 lbs.

66. The enclosure assembly of claim 50, wherein the turbine is at least a double shaft engine.

67. The enclosure assembly of claim 50, wherein the turbine is at least a triple shaft engine.

68. The enclosure assembly of claim 50, wherein the turbine is a triple shaft engine with a three-stage axial low pressure compressor, one centrifugal high pressure compressor, and a two-stage free power turbine.

* * * * *

UNITED STATES PATENT AND TRADEMARK OFFICE

CERTIFICATE OF CORRECTION

PATENT NO. : 6,397,759 B1
DATED : June 4, 2002
INVENTOR(S) : Hubert et al.

It is certified that error appears in the above-identified patent and that said Letters Patent is hereby corrected as shown below:

Title page,
Item [75], should read as follows:

-- [75] Inventors: Daniel Hubert, St-Jean-sur-Richelieu;
Bernard Raynauld, Charlemagne;
Jean Desrosiers, Laval; Martin LaFlamme,
St-Romuald, all of (CA) --

Signed and Sealed this

Eleventh Day of February, 2003

JAMES E. ROGAN
*Director of the United States Patent and Trademark Office*